US009196442B2

(12) United States Patent
Ito et al.

(10) Patent No.: US 9,196,442 B2
(45) Date of Patent: Nov. 24, 2015

(54) CONTACT POINT DEVICE AND ELECTROMAGNETIC RELAY THAT MOUNTS THE CONTACT POINT DEVICE THEREON

(71) Applicant: PANASONIC CORPORATION, Osaka (JP)

(72) Inventors: Masahiro Ito, Mie (JP); Tsukasa Nishimura, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/141,296

(22) Filed: Dec. 26, 2013

(65) Prior Publication Data

US 2014/0184366 A1 Jul. 3, 2014

(30) Foreign Application Priority Data

Dec. 28, 2012 (JP) ..... 2012-288595

(51) Int. Cl.

*H01H 3/00* (2006.01)
*H01H 50/54* (2006.01)
*H01H 1/20* (2006.01)

(52) U.S. Cl.

CPC ..... *H01H 50/54* (2013.01); *H01H 50/546* (2013.01); *H01H 1/2016* (2013.01); *H01H 1/2083* (2013.01)

(58) Field of Classification Search

CPC ..... H01H 50/643; H01H 50/22; H01H 50/36; H01H 50/04; H01H 50/54; H01H 50/30; H01H 50/34; H01H 2050/362; H01H 2235/01

USPC ..... 335/189

See application file for complete search history.

(56) References Cited

U.S. PATENT DOCUMENTS

| | | | | |
|---|---|---|---|---|
| 3,571,770 | A * | 3/1971 | Dew | 335/256 |
| 5,394,128 | A * | 2/1995 | Perreira et al. | 335/126 |
| 5,892,194 | A * | 4/1999 | Uotome et al. | 218/68 |
| 6,911,884 | B2 * | 6/2005 | Uotome et al. | 335/132 |
| 7,852,178 | B2 * | 12/2010 | Bush et al. | 335/126 |
| 7,876,183 | B2 * | 1/2011 | Uruma et al. | 335/126 |
| 8,179,217 | B2 * | 5/2012 | Kawaguchi et al. | 335/80 |
| 8,188,818 | B2 * | 5/2012 | Cho et al. | 335/126 |

(Continued)

FOREIGN PATENT DOCUMENTS

| | | |
|---|---|---|
| JP | S60-246512 A | 12/1985 |
| JP | S64-003934 A | 1/1989 |

(Continued)

*Primary Examiner* — Shawki S Ismail
*Assistant Examiner* — Lisa Homza
(74) *Attorney, Agent, or Firm* — McDermott Will & Emery LLP

(57) ABSTRACT

A contact point device 1 includes a drive block 2 that has a drive shaft 25 to which a movable contactor 29 is attached, and drives the movable contactor 29. The movable contactor 29 is attached to the drive shaft 25 so as to be movable relatively to the drive shaft 25 in an axial direction of the drive shaft, and in addition, relative movement thereof in the axial direction is regulated due to abutment of the movable contactor 29 against a regulating portion 60. Then, between the movable contactor 29 and the regulating portion 60 is formed a rotational movement deregulating portion 80, which relaxes the regulation by the regulating portion 60 for the relative rotational movement of the movable contactor 29 in the axial direction.

12 Claims, 21 Drawing Sheets

(56) References Cited

U.S. PATENT DOCUMENTS

| | | | | |
|---|---|---|---|---|
| 8,248,193 | B2 * | 8/2012 | Kaneda et al. | 335/126 |
| 8,269,585 | B2 * | 9/2012 | Choi | 335/126 |
| 8,274,347 | B2 * | 9/2012 | Eum | 335/201 |
| 8,330,565 | B2 * | 12/2012 | Eum | 335/126 |
| 8,354,905 | B2 * | 1/2013 | Eum | 335/193 |
| 8,549,734 | B2 * | 10/2013 | Yeon | 29/622 |
| 8,674,796 | B2 * | 3/2014 | Ito et al. | 335/260 |
| 8,797,129 | B2 * | 8/2014 | Naka et al. | 335/126 |
| 8,803,642 | B2 * | 8/2014 | Imamura et al. | 335/201 |
| 8,941,453 | B2 * | 1/2015 | Yano et al. | 335/131 |
| 8,975,989 | B2 * | 3/2015 | Yano et al. | 335/132 |
| 2005/0146405 | A1 * | 7/2005 | Nishida et al. | 335/132 |
| 2006/0050466 | A1 * | 3/2006 | Enomoto et al. | 361/160 |
| 2007/0241847 | A1 * | 10/2007 | Yamamoto et al. | 335/196 |
| 2009/0322454 | A1 * | 12/2009 | Tanaka et al. | 335/189 |
| 2009/0322455 | A1 * | 12/2009 | Yoshihara et al. | 335/189 |
| 2011/0032059 | A1 * | 2/2011 | Ito et al. | 335/202 |
| 2011/0221548 | A1 * | 9/2011 | Yoshihara et al. | 335/185 |
| 2013/0234811 | A1 * | 9/2013 | Nishimura | 335/189 |
| 2013/0342293 | A1 * | 12/2013 | Yamamoto et al. | 335/194 |
| 2014/0062626 | A1 * | 3/2014 | Saito et al. | 335/185 |
| 2015/0015350 | A1 * | 1/2015 | Tachikawa et al. | 335/131 |
| 2015/0022291 | A1 * | 1/2015 | Kashimura et al. | 335/131 |
| 2015/0022292 | A1 * | 1/2015 | Tachikawa et al. | 335/131 |
| 2015/0042422 | A1 * | 2/2015 | Horiguchi et al. | 335/127 |

FOREIGN PATENT DOCUMENTS

| | | | |
|---|---|---|---|
| JP | H04-002425 | U | 1/1992 |
| JP | 2006-331756 | A | 12/2006 |
| JP | 2010-010056 | A | 1/2010 |

* cited by examiner

CONTACT POINT DEVICE AND ELECTROMAGNETIC RELAY THAT MOUNTS THE CONTACT POINT DEVICE THEREON

CROSS REFERENCE TO RELATED APPLICATIONS

This application is based upon and claims the benefit of priority from prior Japanese Patent Application 2012-288595 filed on Dec. 28, 2012; the entire contents of which are incorporated by reference herein.

BACKGROUND OF THE INVENTION

The present invention relates to a contact point device and to an electromagnetic relay that mounts the contact point device thereon.

Heretofore, as described in Japanese Patent Laid-Open Publication No. 2010-010056 (hereinafter, referred to as Patent Literature 1), there has been known a contact point device, which includes: a contact point block having fixed terminals provided with fixed contact points, and having a movable contactor provided with movable contact points contacting and separating from the fixed contact points; and a drive block having a drive shaft that drives the movable contactor.

In this Patent Literature 1, to one end portion of the drive shaft formed so as to reciprocally move in an axial direction thereof, the movable contactor is attached so as to be movable relatively to the drive shaft in the axial direction. Then, the movable contactor is sandwiched by a first yoke and a second yoke, and is attached to the drive shaft in a state where such relative movement to the drive shaft is regulated by the first yoke.

SUMMARY OF THE INVENTION

Incidentally, in the above-described conventional technology, not only such parallel movement of the movable contactor to one end side thereof in the axial direction is regulated, but also relative rotational movement of the movable contactor in the axial direction is regulated. That is to say, in the above-described conventional technology, the relative rotational movement of the movable contactor in the axial direction is regulated by the first yoke, and accordingly, the contact point device has such a structure as it is difficult to relatively rotationally move the movable contactor in the axial direction.

In this connection, it is an object of the present invention to obtain a contact point device capable of relatively rotationally moving the movable contactor in such a drive shaft direction more easily, and to obtain an electromagnetic relay that mounts the contact point device thereon.

A first feature of the present invention is a contact point device including: a contact point block having a fixed terminal in which a fixed contact point is formed and a movable contactor in which a movable contact point contacting and separating from the fixed contact point is formed; and a drive block having a drive shaft to which the movable contactor is attached and which drives the movable contactor so that the movable contact point can contact and separate from the fixed contact point, wherein the movable contactor is attached to the drive shaft so as to be movable relatively to the drive shaft in an axial direction of the drive shaft, a regulating portion is provided, which regulates the relative movement of the movable contactor in the axial direction by allowing the movable contactor to abut against the regulating portion itself, and between the movable contactor and the regulating portion, a rotational movement deregulating portion is formed, which relaxes the regulation by the regulating portion for the relative rotational movement of the movable contactor in the axial direction.

A second feature of the present invention is that the movable contactor and the regulating portion are arranged at an interval from each other in the axial direction by the rotational movement deregulating portion.

A third feature of the present invention is that, when viewed from the above, the regulating portion is formed so as to cover an abutment portion of the rotational movement deregulating portion against the movable contactor or the regulating portion.

A fourth feature of the present invention is that the rotational movement deregulating portion is a protruding portion formed on at least either one of the movable contactor and the regulating portion.

A fifth feature of the present invention is that the rotational movement deregulating portion is formed by bending at least either one of the movable contactor and the regulating portion.

A sixth feature of the present invention is that the rotational movement deregulating portion is formed of a separate material from the movable contactor and the regulating portion.

A seventh feature of the present invention is that a plurality of the protruding portions are formed.

An eighth feature of the present invention is that the rotational movement deregulating portion has a step difference portion on an opposite surface thereof to the movable contactor or the regulating portion.

A ninth feature of the present invention is that the rotational movement deregulating portion has an inclined surface portion on an opposite surface thereof to the movable contactor or the regulating portion.

A tenth feature of the present invention is that the rotational movement deregulating portion has a curved surface portion on an opposite surface thereof to the movable contactor or the regulating portion.

An eleventh feature of the present invention is that the contact point block includes a biasing member which urges the movable contactor towards a first side of the movable contactor in the axial direction of the drive shaft, and includes a yoke provided at least on a second side of the movable contactor in the axial direction in a state where the movable contact point is in contact with the fixed contact point, and the biasing member includes a biasing end which is located towards the movable contactor on the second side in the axial direction but separate from a surface of the yoke provided on the second side in the axial direction and which applies a biasing force to the movable contactor not via the yoke.

A twelfth feature of the present invention is that an electromagnetic relay mounts the contact point device thereon.

BRIEF DESCRIPTION OF THE DRAWINGS

FIG. 4A is a side cross-sectional view; and FIG. 4B is a side cross-sectional view cut along a direction perpendicular to FIG. 4A.

FIG. 5A is a perspective view enlargedly showing a main portion of the contact point unit; and FIG. 5B is a cross-sectional view schematically showing an arrangement relationship between upper and lower yokes and a movable contactor.

DETAILED DESCRIPTION OF THE PREFERRED EMBODIMENTS

Figure 4B:
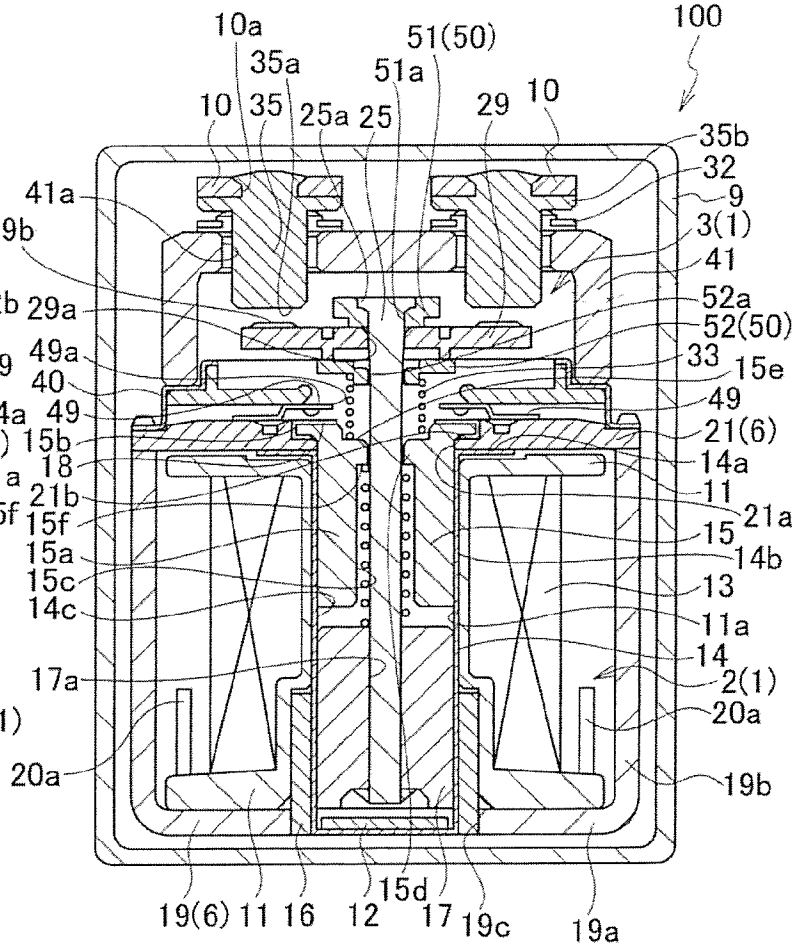
FIGS. 4A and 4B are views showing the electromagnetic relay according to the embodiment of the present invention.
Figure 4A:
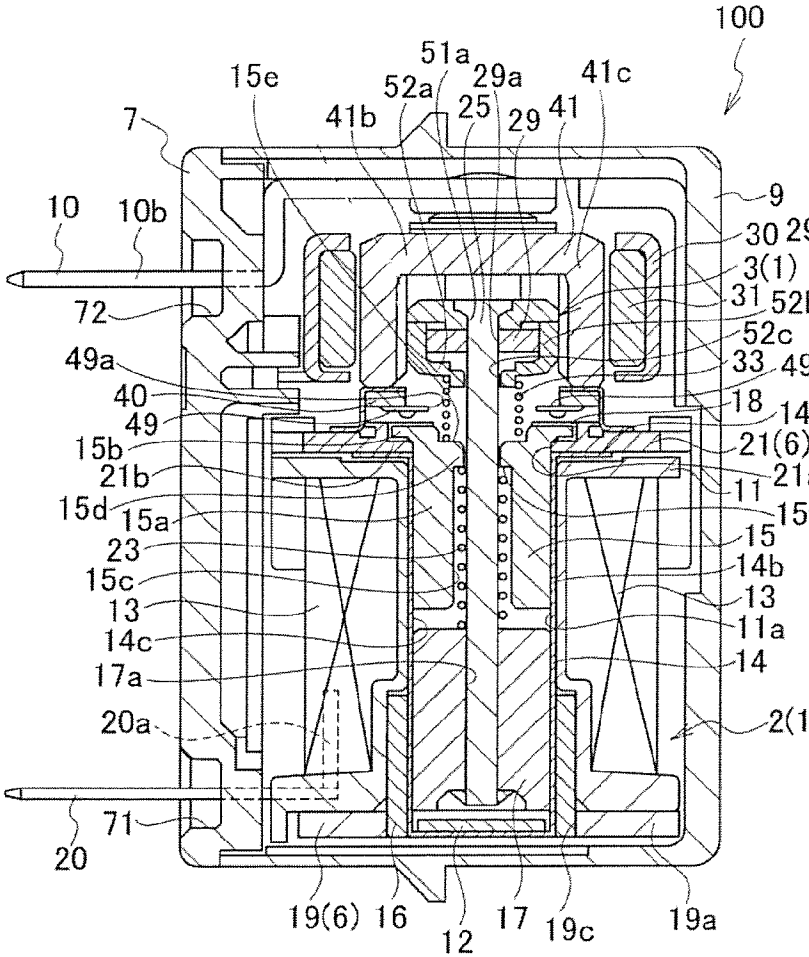
Figure 5A:
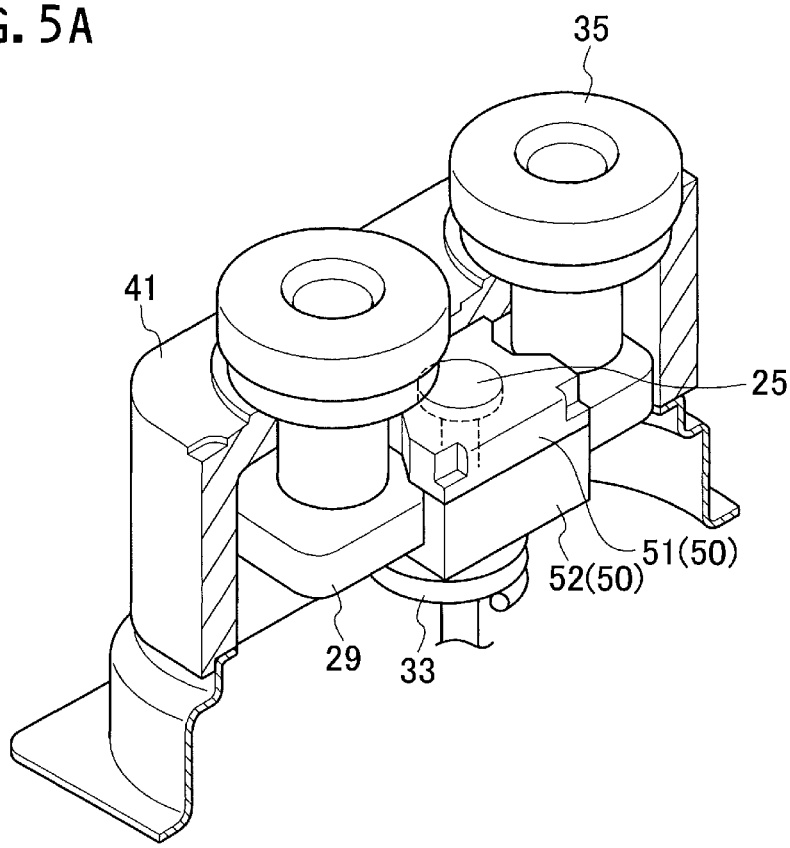
FIGS. 5A and 5B are views schematically showing a contact point unit of the contact point device according to the embodiment of the present invention.
Figure 5B:
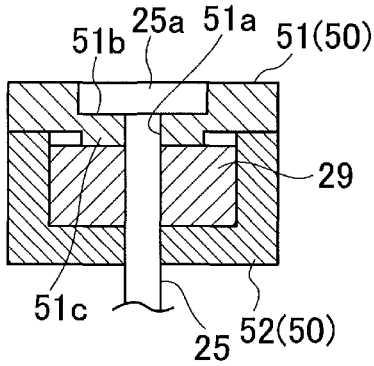

A description is made below in detail of an embodiment of the present invention while referring to the drawings. Note that, in the following, the description is made on the assumption that up and down and right and left in FIG. 4B are up and down and right and left, and that right and left in FIG. 4A are front and back, respectively.

Figure 1:
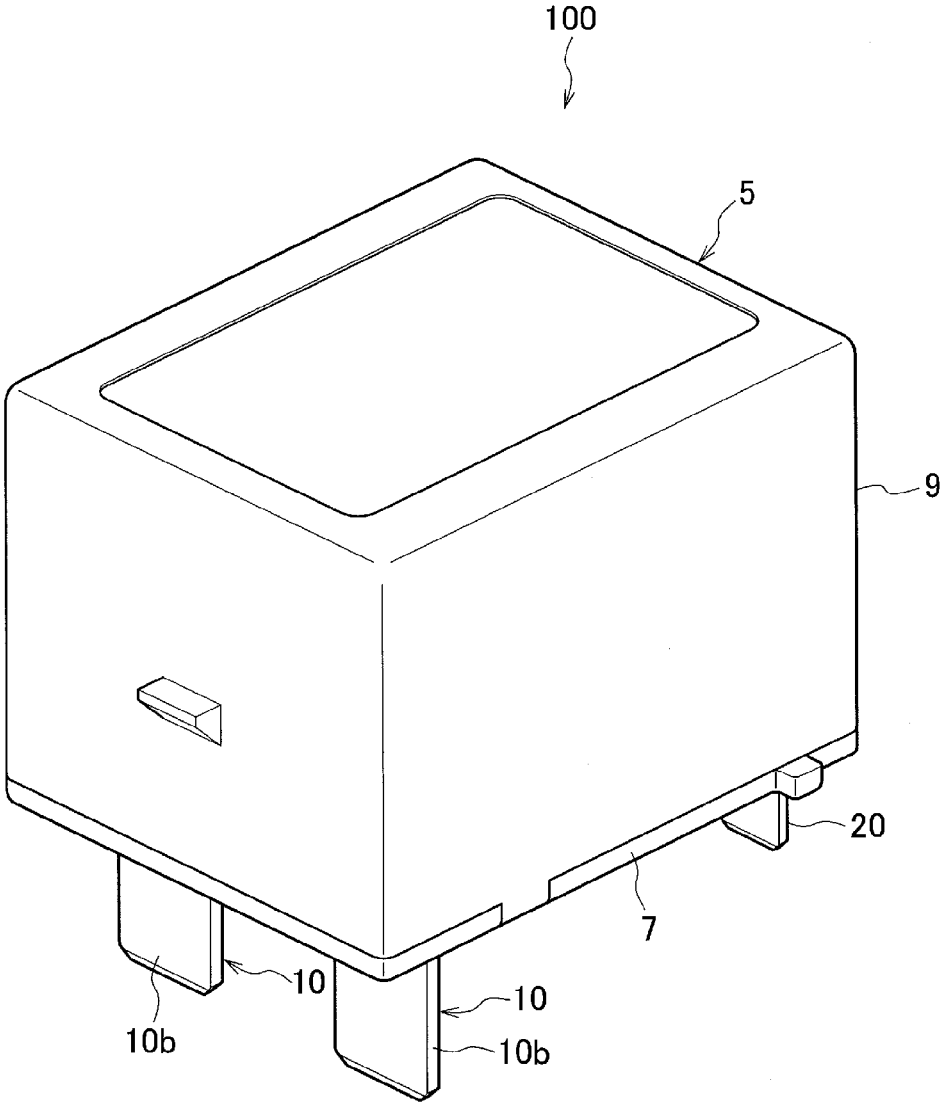
FIG. 1 is a perspective view showing an electromagnetic relay according to an embodiment of the present invention.
Figure 2:
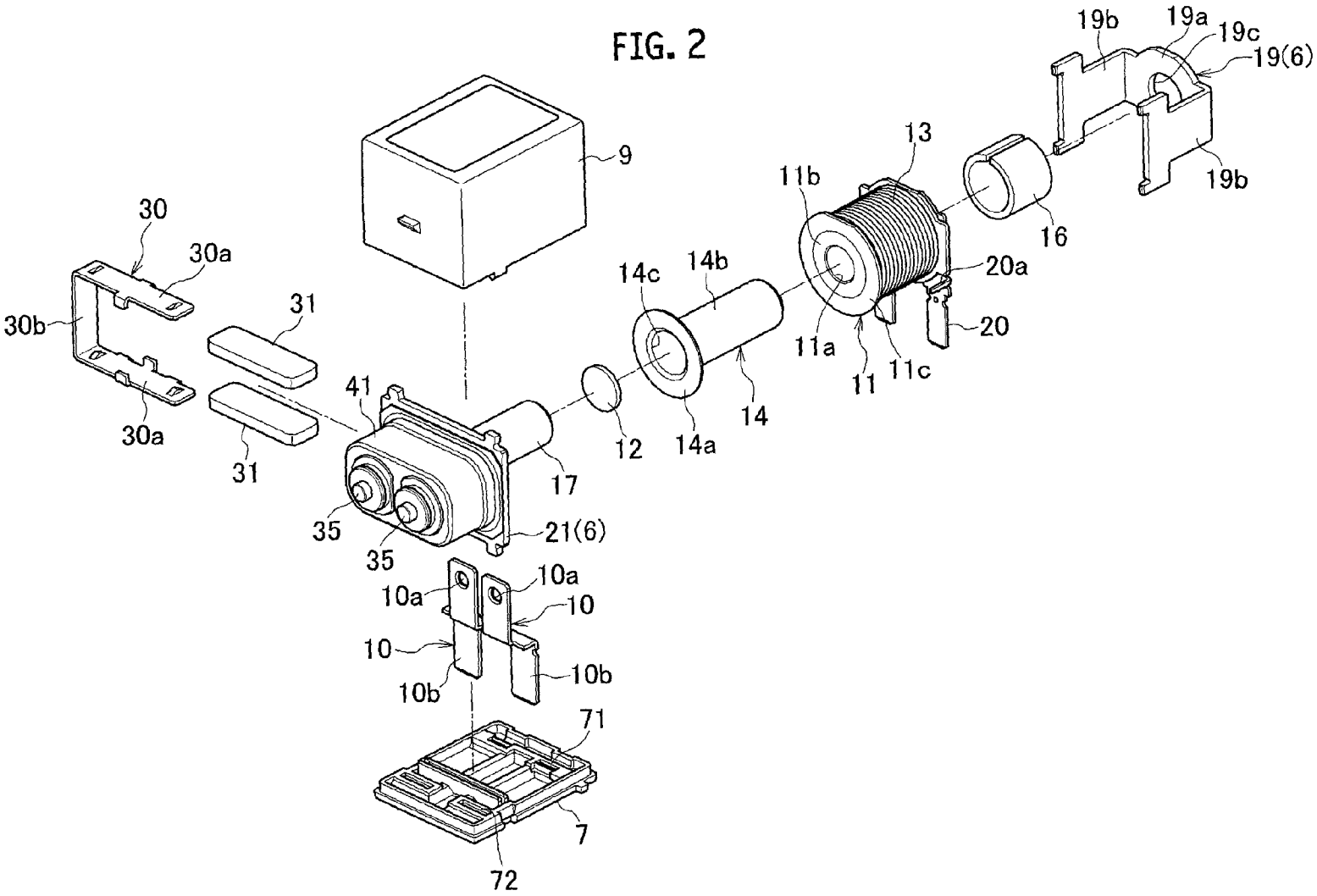
FIG. 2 is an exploded perspective view of the electromagnetic relay according to the embodiment of the present invention.
Figure 3:
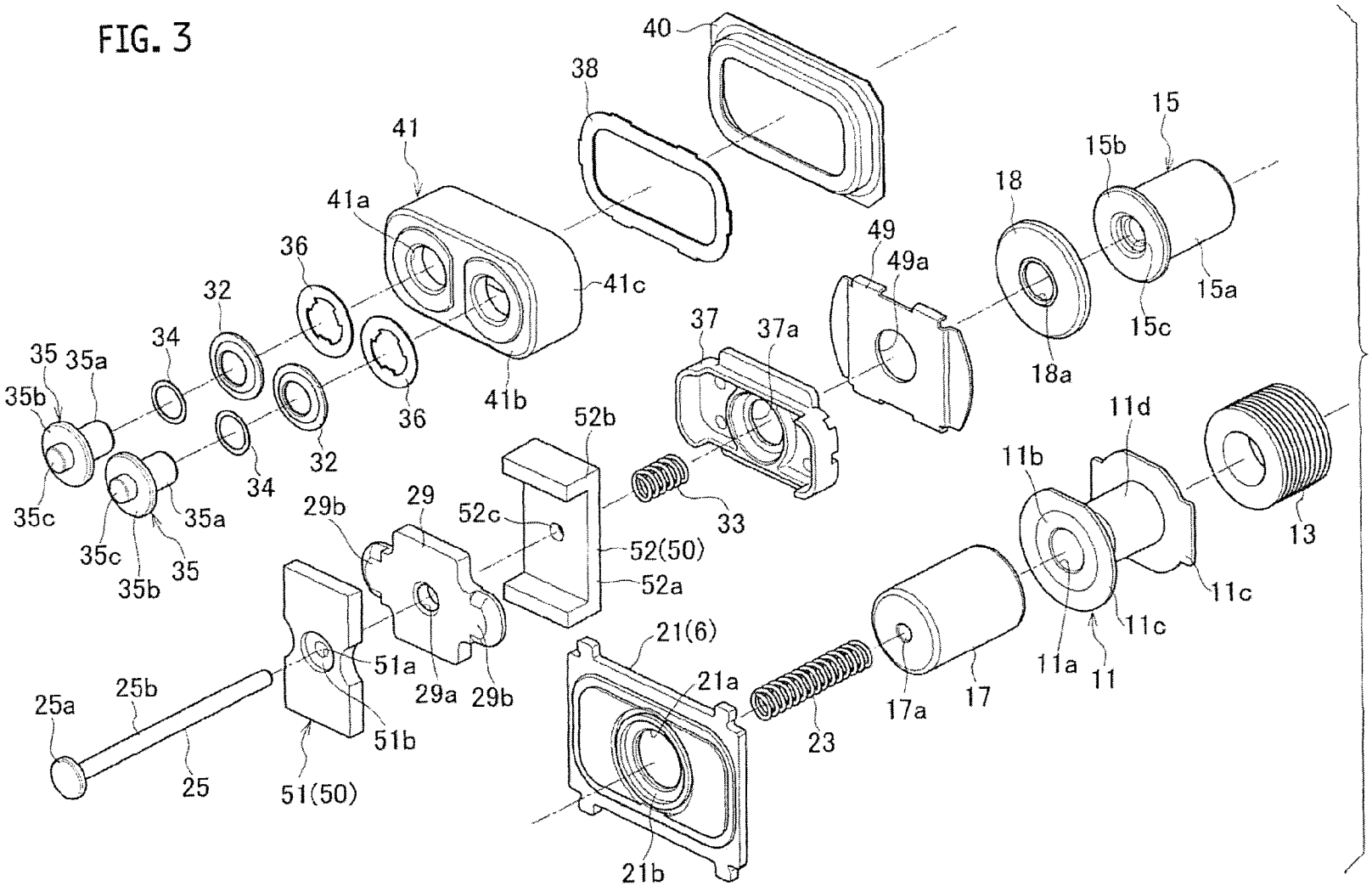
FIG. 3 is an exploded perspective view showing a part of a contact point device according to the embodiment of the present invention with the part disassembled.

An electromagnetic relay 100 according to this embodiment is a so-called normally open-type one in which a contact point turns off in an initial state, and as shown in FIG. 1 to FIG. 3, includes a contact point device 1 composed by combining a drive block 2, which is located below, and a contact point block 3, which is located above, integrally with each other. Then, the contact point device 1 is housed in a hollow box-like case 5. Note that a so-called normally closed-type electromagnetic relay in which a contact point turns on in an initial state is also usable.

The case 5 includes: a substantially rectangular case base portion 7; and a case cover 9, which is arranged so as to cover this case base portion 7 and houses mounted components such as the drive unit (drive block) 2 and the contact point unit (contact point block) 3.

In the case base portion 7, on a lower portion side thereof in FIG. 4, a pair of slits (insertion holes) 71 and 71, on which a pair of coil terminals 20 are individually mounted, are provided. Moreover, in the case base portion 7, on an upper portion side thereof in FIG. 4, a pair of slits (insertion holes) 72 and 72, on which terminal portions 10*b* and 10*b* of a pair of main terminals 10 and 10 are mounted, are individually provided. Meanwhile, the case cover 9 is formed into a hollow box shape with a case base portion 7 side opened. Note that the insertion holes 71 have substantially the same shape as a cross-sectional shape of the coil terminals 20, and the insertion holes 72 have substantially the same shape as a cross-sectional shape of the terminal portions 10*b* of the main terminals 10.

The drive block 2 includes: a hollow cylindrical coil bobbin 11 around which a coil 13 is wound; and the pair of coil terminals 20, which are fixed to the coil bobbin 11, and have both ends of the coil 13 connected individually thereto.

The coil bobbin 11 includes substantially circular flange portions 11*c*, which protrude in a circumferential direction on both of upper and lower ends of a cylindrical portion thereof. Between the upper and lower flange portions 11*c* is formed a winding drum portion 11*d* with the coil 13 wound around.

The coil terminals 20 are formed into a flat plate shape by using a conductive material such as copper. In the pair of coil terminals 20 are individually formed relay terminals 20*a*. Then, to the respective relay terminals 20*a* are soldered leader lines on both ends of the coil 13 wound around the coil bobbin 11 in a state of being tied thereto.

Then, the coil 13 is energized through the pair of coil terminals 20, whereby the drive block 2 is driven. The drive block 2 is thus driven, whereby contact points, each including a fixed contact point 35*a* and movable contact point 29*b* of the contact point block 3 to be described later, are opened and closed, thereby enabling to switch conduction and non-conduction between a pair of fixed terminal strips 35.

Moreover, the drive block 2 includes a yoke 6 made of a magnetic material and surrounding the coil bobbin 11. In this embodiment, the yoke 6 includes: a rectangular yoke upper plate 21 that abuts against an upper end surface of the coil bobbin 11; and a rectangular yoke 19 that abuts against a lower end surface and side surface of the coil bobbin 11. The yoke 6 is opened in a front-back direction.

The yoke 19 is arranged between the coil 13 and the case 5. This yoke 19 includes: a bottom wall 19*a*; and a pair of sidewalls 19*b* and 19*b* upstanding from circumferential edges of the bottom wall 19*a*. In this embodiment, the bottom wall 19*a* and the pair of sidewalls 19*b* and 19*b* are formed continuously and integrally with one another by bending one plate. Moreover, in the bottom wall 19*a* of the yoke 19, an annular through hole 19*c* is formed. A bush 16 made of a magnetic material is mounted on this through hole 19*c*. Then, on tip end sides (upper end sides) of the pair of sidewalls 19*b* and 19*b* of the yoke 19, the above-mentioned yoke upper plate 21 is arranged so as to cover the coil 13 wound around the coil bobbin 11.

Moreover, the drive block 2 includes: a fixed iron core 15, which is fixed to a cylindrical inside of the coil bobbin 11 and is magnetized by the energized coil 13; and a movable iron core 17, which is opposite to the fixed iron core 15 in an up-down direction (axial direction) and is arranged in the cylinder of the coil bobbin 11. The fixed iron core 15 is formed into a substantially cylindrical shape, in which a flange portion 15*b* is provided on an upper end portion of a protrusion portion 15*a* so as to protrude in the circumferential direction, the protrusion portion 15*a* having a through hole 15*c* formed therein.

Furthermore, in this embodiment, the drive block 2 includes a plunger cap 14 made of a magnetic material and formed into a closed-bottom cylindrical shape with an upper surface opened between the fixed iron core 15 and the movable iron core 17 and the coil bobbin 11. In this embodiment, the plunger cap 14 is arranged in the through hole 11*a* formed in the center of the coil bobbin 11. At this time, an annular seat surface 11*b* is formed on an upper side of the coil bobbin 11, and a flange portion 14*a* of the plunger cap 14 is mounted on this seat surface 11*b*. Then, a protrusion portion 14*b* of the plunger cap 14 is fitted into the through hole 11*a*. Moreover, the fixed iron core 15 and the movable iron core 17 are housed in the plunger cap 14 provided in the cylindrical inside of the coil bobbin 11. Note that the fixed iron core 15 is arranged on an opening side of the plunger cap 14.

Furthermore, each of the fixed iron core 15 and the movable iron core 17 is formed into a columnar shape in which an outer diameter is substantially the same diameter as an inner diameter of the plunger cap 14, and the movable iron core 17 slides in the cylindrical inside of the plunger cap 14. A movement range of this movable iron core 17 is set between an initial position away from the fixed iron core 15 and an abutment position for abutting against the fixed iron core 15. Moreover, between the fixed iron core 15 and the movable iron core 17, there is interposed a return spring 23, which includes a coil spring and urges the movable iron core 17 in a direction of returning the same to the initial position. By this return spring 23, the movable iron core 17 is urged in a direction (downward in FIG. 4) to be spaced apart from the fixed iron core 15. Note that, in this embodiment, in the through hole 15*c* of the fixed iron core 15, a protrusion 15*d*, which protrudes toward a center side thereof and reduces a hole diameter thereof, is provided over a whole circumference thereof, and a lower surface 15*f* of this protrusion 15*d* becomes a spring receiving portion for the return spring 23.

Moreover, in a center portion of the yoke upper plate 21, an insertion hole 21*a* through which the fixed iron core 15 is inserted is provided so as to penetrate the same. Then, when inserting the fixed iron core 15 through the insertion hole 21*a*, a cylindrical portion 15*b* of the fixed iron core 15 is inserted from an upper surface side of the yoke upper plate 21. At this time, in an upper surface substantial center of the yoke upper plate 21 is provided a recessed portion 21*b* with substantially the same diameter as that of the flange portion 15*b* of the fixed iron core 15, and the flange portion 15*b* of the fixed iron core 15 is fitted into the recessed portion 21*b*, whereby falloff of the fixed iron core 15 is prevented.

Furthermore, on the upper surface side of the yoke upper plate 21, a presser plate 49 made of metal is provided, and right and left end portions thereof are fixed to the upper surface of the yoke upper plate 21. Then, a protruding portion on the center of the presser plate 49 is provided so as to form a space for housing the flange portion 15*b* of the fixed iron core 15, which protrudes from the upper surface of the yoke upper plate 21. Furthermore, in this embodiment, an iron core rubber 18 made of a material (for example, synthetic rubber) having rubber elasticity is provided between the fixed iron core 15 and the presser plate 49, whereby vibrations coming from the fixed iron core 15 are prevented from directly propagating to the presser plate 49. This iron core rubber 18 is formed into a disc shape, and in a center portion thereof, an insertion hole 18*a* through which a shaft (drive shaft) 25 to be described later is inserted is provided so as to penetrate the same. Furthermore, in this embodiment, the iron core rubber 18 is fitted to the fixed iron core 15 so as to wrap the flange portion 15*b*.

On the opening side of the plunger cap 14 is formed the flange portion 14*a* that protrudes in the circumferential direction. This flange portion 14*a* is fixedly attached to a circumference of the insertion hole 21*a* on a lower surface of the yoke upper plate 21. Then, a lower end bottom portion of the plunger cap 14 is inserted into the bush 16 mounted into the through hole 19*c* of the bottom wall 19*a*. At this time, the movable iron core 17 housed in a lower portion of the plunger cap 14 is magnetically joined to a circumference portion of the bush 16.

By adopting such a configuration, at the time of energizing the coil 13, as a pair of magnetic pole portions, an opposite surface of the fixed iron core 15 to the movable iron core 17 and an opposite circumference portion of the bottom wall 19*a* to the bush 16 turn to different polarities from each other, and the movable iron core 17 is sucked by the fixed iron core 15 and moves to the abutment position. Meanwhile, when such energization to the coil 13 is stopped, the movable iron core 17 returns to the initial position by the return spring 23. Note that the return spring 23 is inserted through the insertion hole 15*c* of the fixed iron core 15, an upper end thereof abuts against the lower surface 15*f* of the protrusion 15*d*, and in addition, a lower surface thereof abuts against an upper surface of the movable iron core 17. Furthermore, in this embodiment, on the bottom portion of the plunger cap 14, there is provided a dumper rubber 12, which is made of a material having the rubber elasticity and is formed to have substantially the same diameter as the outer diameter of the movable iron core 17.

Moreover, the contact point block 3, which opens and closes the contact point in response to ON/OFF of the energization to the coil 13, is provided above the drive block 2.

The contact point block 3 includes a base 41, which is formed into a box shape with an open lower surface by using a heat-resistant material. Then, in a bottom portion of the base 41, two insertion holes 41*a* are provided, and into the through holes 41*a*, a pair of fixed terminals 35 are inserted while sandwiching lower flanges 32 therebetween. The fixed terminals 35 are formed into a cylindrical shape by using a conductive material such as a copper-based material. On lower end surfaces of the fixed terminals 35, the fixed contact points 35*a* are formed, on upper end portions of which are formed flange portions 35*b* protruding in a circumferential direction thereof. At the centers of the flange portions 35*b*, protruding portions 35*c* are provided. Then, upper surfaces of the lower flanges 32 and the flange portions 35*b* of the fixed terminals 35 are hermetically joined to each other by silver solders 34, and lower surfaces of the lower flanges 32 and an upper surface of the base 41 are also hermetically joined to each other by silver solders 36.

Moreover, the pair of main terminals 10 and 10 connected to an external load or the like are attached to the fixed terminals 35. The main terminals 10 and 10 are formed into a flat plate shape by using a conductive material, and intermediate portions thereof in the front-back direction are bent into a stair case shape. On front ends of the main terminals 10 and 10 are formed insertion holes 10*a* and 10*a* through which the protruding portions 35*c* of the fixed terminals 35 are inserted. The protruding portions 35*c* inserted through the insertion holes 10*a* and 10*a* are subjected to spin riveting process, whereby the main terminals 10 and 10 are fixed to the fixed terminals 35.

Moreover, in the base 41, a movable contactor 29 is arranged in a form of lying astride the pair of fixed contact points 35*a*, and the movable contact points 29*b* are individually provided on regions of an upper surface of the movable contactor 29, which are opposite to the fixed contact points 35*a*. Then, in a center portion of the movable contactor 29 is provided an insertion hole 29*a*, through which one end portion of the shaft 25 is inserted, so as to penetrate the same. Here, the shaft 25 is a shaft that couples the movable contactor 29 to the movable iron core 17.

The shaft 25 is made of a non-magnetic material, and includes: a round stick-like shaft body portion 25*b* elongated in a moving direction (up-down direction) of the movable iron core 17; and a flange portion 25*a* formed on a portion so as to protrude in a circumferential direction thereof, the portion protruding upward from the movable contactor 29.

Furthermore, between the movable contactor 29 and the presser plate 49, there are provided: an insulating plate 37 which is made of an insulating material and is formed so as to cover the presser plate 49; and a contact pressure spring (a biasing member) 33, which is formed of a coil spring, and has the shaft 25 inserted therethrough. Note that, in the center of the insulating plate 37 is provided an insertion holes 37*a* through which the shaft 25 is inserted, and the movable contactor 29 is urged in an upper direction (towards a first side in the axial direction) by the contact pressure spring 33.

Here, a positional relationship between the movable iron core 17 and the movable contactor 29 is set so that the movable contact points 29*b* and the fixed contact points 35*a* can be spaced apart from each other when the movable iron core 17 is located at the initial position, and that the movable contact points 29*b* and the fixed contact points 35*a* can contact each other when the movable iron core 17 is located at the abutment position. That is to say, during a period while the coil 13 is not being energized, the contact point device 3 turns off, whereby both of the fixed terminals 35 are insulated from each other, and during a period while the coil 13 is being energized, the contact point device 3 turns on, whereby both of the fixed terminals 35 are conducted to each other. Note that a contact pressure between the movable contact points 29*b* and the fixed contact points 35*a* is ensured by the contact pressure spring 33.

Incidentally, when a current flows between the movable contact points 29*b* of the movable contactor 29 and the fixed contact points 35*a* and 35*a* in state where both thereof are brought into contact with each other, electromagnetic repulsive force acts between the fixed contact points 35*a*, 35*a* and the movable contactor 29 by this current. When the electromagnetic repulsive force acts between the fixed contact points 35*a*, 35*a* and the movable contactor 29, then therebetween, a contact point pressure is lowered, and contact resistance is increased, whereby Joule heat is suddenly increased, and the contact points are opened and separated from each other to thereby generate arc heat. Therefore, there is an apprehension that the movable contact points 29*b* and the fixed contact points 35*a* may be welded to each other.

In this embodiment, therefore, a yoke 50 is provided so as to surround the movable contactor 29. Specifically, the yoke 50 that surrounds upper and lower surfaces and side surface of the movable contactor 29 includes: an upper yoke (first yoke) 51 arranged above the movable contactor 29; and a lower yoke (second yoke) 52 that surrounds a lower side and a side portion of the movable contactor 29. As described above, the movable contactor 29 is surrounded by the upper yoke 51 and the lower yoke 52, whereby a magnetic circuit is formed between the upper yoke 51 and the lower yoke 52.

Then, by providing the upper yoke 51 and the lower yoke 52, in the event where the current flows between the movable contact points 29*b* and the fixed contact points 35*a*, 35*a* when both thereof contact each other, the upper yoke 51 and the lower yoke 52 generate magnetic forces, which suck each other, based on the current concerned. Thus, the magnetic forces sucking each other are generated, causing the upper yoke 51 and the lower yoke 52 to suck each other, whereby the movable contactor 29 is pressed against the fixed contact points 35*a*, which regulates an operation for the movable contactor 29 to be opened and separated from the fixed contact points 35*a*. By this regulation of the operation for the movable contactor 29 to be opened and separated from the fixed contact points 35*a*, the movable contact points 29*b* stick to the fixed contact points 35*a* without allowing the movable contactor 29 to repel the fixed contact points 35*a*, and accordingly, an occurrence of the arc is suppressed. As a result, it becomes possible to suppress contact point welding which may be occurred by the occurrence of the arc.

Moreover, in this embodiment, the upper yoke 51 is formed into a substantially rectangular plate shape, and the lower yoke 52 is formed into a substantially U-like shape by using a bottom wall portion 52*a* and sidewall portions 52*b* so as to upstand from both ends of the bottom wall portion 52*a*. At this time, as shown in FIG. 4A, preferably, upper end surfaces of the sidewall portions 52*b* of the lower yoke 52 are allowed to abut against a lower surface of the upper yoke 51; however, the upper end surfaces of the sidewall portions 52*b* of the lower yoke 52 do not have to be allowed to abut against the lower surface of the upper yoke 51.

Then, in this embodiment, the movable contactor 29 is urged upward through the lower yoke 52 by the contact pressure spring 33. Specifically, the contact pressure spring 33 is configured so that an upper end thereof can abut against the lower surface of the lower yoke 52, and in addition, that a lower end thereof can abut against an upper surface 15*e* of the protrusion 15*d*. Thus, in this embodiment, the upper surface 15*e* of the protrusion 15*d* serves as a spring receiving portion for the contact pressure spring 33.

Moreover, in the upper yoke 51, the lower yoke 52 and the presser plate 49, there are formed an insertion hole 51*a*, an insertion hole 52*c* and an insertion hole 49*a*, respectively, to insert the shaft 25.

Then, the movable contactor 29 is attached to one end portion of the shaft 25 in such a manner as mentioned below.

First, from the lower side, the movable iron core 17, the return spring 23, the yoke upper plate 21, the fixed iron core 15, the iron core rubber 18, the presser plate 49, the insulating plate 37, the contact pressure spring 33, the lower yoke 52, the movable contactor 29 and the upper yoke 51 are arranged in this order. At this time, the return spring 23 is inserted into the through hole 21*a* of the yoke upper plate 21 and the through hole 15*c* of the fixed iron core 15 in which the protruding portion 15*a* is fitted to the through hole 14*c* of the plunger cap 14.

Then, from above the upper yoke 51, the body portion 25*b* of the shaft 25 is inserted through the respective through holes 51*a*, 29*a*, 52*c*, 37*a*, 49*a*, 18*a*, 15*c* and 21*a*, the contact pressure spring 33 and the return spring 23, and is then inserted through the insertion hole 17*a* of the movable iron core 17, whereby the shaft 25 is coupled to the movable iron core 17. In this embodiment, as shown in FIG. 4, such coupling of the shaft 25 to the movable iron core 17 is performed by crushing a tip end thereof and performing rivet coupling therefor. Note that a thread groove is formed on other end portion of the shaft 25 to screw the shaft 25 into the movable iron core 17, so that the shaft 25 may be coupled to the movable iron core 17.

In such a way, the movable contactor 29 is attached to the one end portion of the shaft 25. In this embodiment, an annular seat surface 51*b* is formed on an upper side of the upper yoke 51, and the flange portion 25*a* of the shaft 25 is housed in this seat surface 51*b*, whereby the shaft 25 is prevented from falling off while suppressing upward protrusion of the shaft 25. Note that the shaft 25 may be fixed to the upper yoke 51 by laser welding and the like.

Moreover, with regard to the insertion hole 15*c* provided in the fixed iron core 15, an inner diameter thereof is set larger in comparison with an outer diameter of the shaft 25 so that at least the shaft 25 can be prevented from contacting the fixed iron core 15. By adopting such a configuration, the movable contactor 29 moves in the up-down direction in an interlocking manner with the movement of the movable iron core 17.

Moreover, in this embodiment, gas is encapsulated in the base 41 in case the movable contact points 29*b* are separated from the fixed contact points 35*a*, in order to suppress the arc, which would happen between the movable contact points 29*b* and the fixed contact points 35*a*. As such gas, mixed gas can be used, which mainly contains hydrogen gas most excellent in thermal conduction in a temperature range at which the arc occurs. In this embodiment, an upper flange 40, which covers a gap between the base 41 and the yoke upper plate 21, is provided in order to enclose this gas.

Specifically, the base 41 includes: a top wall 41*b* in which a pair of the through holes 41*a* are juxtaposed; and a square tube-like wall portion 41*c* upstanding from a rim of this top wall 41*b*. The base 41 is formed into a hollow box shape in which a lower side (movable contactor 29 side) is opened. Then, in a state where the movable contactor 29 is housed in the inside of the wall portion 41*c* from such an opened lower side, the base 41 is fixed to the yoke upper plate 21 through the upper flange 40.

In this embodiment, a rim portion of an opening of the lower surface of the base 41 and an upper surface of the upper flange 40 are hermetically joined to each other by silver solder 38, and in addition, a lower surface of the upper flange 40 and the upper surface of the yoke upper plate 21 are hermetically joined to each other by arc welding and the like. Furthermore, the lower surface of the yoke upper plate 21 and the flange portion 14*a* of the plunger cap 14 are hermetically joined to each other by the arc welding and the like. In such a way, a sealed space S with the gas encapsulated in the base 41 is formed.

Furthermore, in this embodiment, together with such an arc suppression method using the gas, arc suppression using a capsule yoke is also performed. The capsule yoke is composed of a magnetic member 30 and a pair of permanent magnets 31, and the magnetic member 30 is formed into a substantially U-like shape by using a magnetic material such as iron. This magnetic member 30 is formed integrally with a pair of opposing side pieces 30*a* and a coupling piece 30*b* which couples base end portions of both of the side pieces 30*a* to each other.

The permanent magnets 31 are attached to both of the side pieces 30*a* of the magnetic member 30 so as to be individually opposed to both of the side pieces 30*a*. The permanent magnets gives to the base 41 a magnetic field substantially perpendicular to a contacting/separating direction of the movable contact points 29*b* with respect to the fixed contact points 35*a*. In such a way, the arc is stretched in a direction perpendicular to such a moving direction of the movable contactor 29 and in addition, is cooled by the gas encapsulated in the base 41, and is shut off at the point of time when an arc voltage suddenly rises and exceeds a voltage between the contact points. That is to say, in the electromagnetic relay 100 of this embodiment, measures against the arc are taken by a magnetic blow by the capsule yoke and by the gas encapsulated in the base 41. In such a way, it becomes possible to shut off the arc in a short time, and exhaustion of the fixed contact points 35*a* and the movable contact points 29*b* can be reduced.

Incidentally, in the electromagnetic relay 100 of this embodiment, the movable iron core 17 is guided in the moving direction (up-and-down direction) by the plunger cap 14, and accordingly, a position thereof on a plane perpendicular to the moving direction is regulated. Hence, in the shaft 25 connected to the movable iron core 17 as well, a position thereof within a plane perpendicular to the moving direction of the movable iron core 17 is regulated. Furthermore, in this embodiment, in the fixed iron core 15 as well, the shaft 25 is inserted through the insertion hole 15*c*, whereby a position of the shaft 25 within a plane perpendicular to the moving direction of the movable iron core 17 is regulated. That is to say, the insertion hole 15*c* of the fixed iron core 15 is formed so that an inner diameter of a region thereof having the protrusion 15*d* formed can be substantially the same as the outer diameter of the shaft 25. That is to say, the inner diameter of the insertion hole 15*c* is set at a diameter to enable the shaft 25 to move in the up-down direction while regulating the forward, backward, rightward and leftward movements of the shaft 25.

By adopting such a configuration, an inclination of the shaft 25 with respect to the moving direction of the movable iron core 17 is regulated by two spots, that is, the plunger cap 14 and the protrusion 15*d* of the fixed iron core 15. Hence, even if the shaft 25 is about to be inclined with respect to the moving direction of the movable iron core 17, the position of the shaft 25 within the plane perpendicular to the moving direction of the movable iron core 17 is regulated by two spots, that is, the lower end of the movable iron core 17 and the protrusion 15*d* of the fixed iron core 15, thereby regulating the inclination of the shaft 25. As a result, straightness of the shaft 25 is ensured, and the shaft 25 can be suppressed from being inclined.

Next, a description is made of operations of the contact point device 1.

First, in a state where the coil 13 is not energized, elastic force of the return spring 23 overcomes elastic force of the contact pressure spring 33, the movable iron core 17 moves in the direction to separate from the fixed iron core 15, which brings about a state of FIGS. 4A, 4B, where the movable contact points 29*b* are isolated from the fixed contact points 35*a*.

When the coil 13 is energized from such an OFF state, the movable iron core 17 moves to approach the fixed iron core 15 by the electromagnetic force so as to be sucked to the fixed iron core 15 against the elastic force of the return spring 23. Following the movement of the movable iron core 17 to the upper side (fixed iron core 15 side), the shaft 25, the upper yoke 51, the movable contactor 29, and the lower yoke 52, which are attached to the shaft 25, move to the upper side (fixed contact points 35*a* side). Thus, the movable contact points 29*b* of the movable contactor 29 contact the fixed contact points 35*a* of the fixed terminals 35, and the respective contact points electrically conduct to each other, whereby the contact point device turns ON.

Here, in this embodiment, the movable contactor 29 is attached to the shaft 25 so as to be movable relatively to the shaft (drive shaft) 25 in the axial direction of the shaft 25. Specifically, the movable contactor 29 is attached to the shaft 25 so as to become movable in parallel in the axial direction of the shaft (drive shaft) 25, and so as to become rotationally movable relatively thereto in the axial direction. Note that the relative rotational movement of the movable contactor 29 in the axial direction of the shaft 25 means that, in a state where the shaft 25 is arranged so that the axial direction thereof can be extended in the up-down direction, one end of the movable contactor 29 moves upward, and the other end thereof moves downward. In particular, in this embodiment, the description is made under the following definition. Specifically, such motions that one end of the movable contactor 29 moves upward and the other end thereof moves downward in a state where the shaft 25 is arranged so that the axial direction thereof can be extended in the up-down direction and in a state where the movable contact 29 is viewed in a lateral direction thereof (a state where the movable contactor 29 is viewed such that at least one of the movable contact points 29*b* is present on each side of the shaft 25) are the rotational movement of the movable contactor 29 in the axial direction of the shaft 25, which is relative to the shaft 25.

Then, the parallel movement of the movable contactor 29 in the axial direction and the relative rotational movement thereof in the axial direction are regulated in such a manner that the movable contactor 29 abuts against a regulating portion 60.

In this embodiment, the upper yoke 51 corresponds to the regulating portion 60, and this upper yoke 51 abuts against the upper surface of the movable contactor 29, whereby the relative movement (parallel movement and relative rotational movement) of the movable contactor 29 toward one end side (upward: axial direction) is regulated.

Figure 7A:
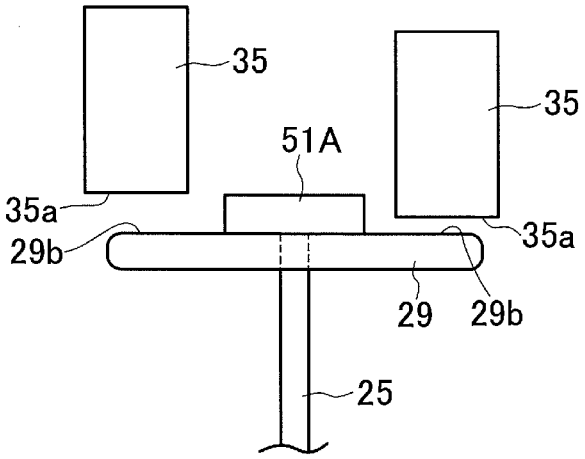
FIGS. 7A and 7B are side views schematically showing operations of a movable contactor and a regulating portion according to a comparative example.
Figure 7B:
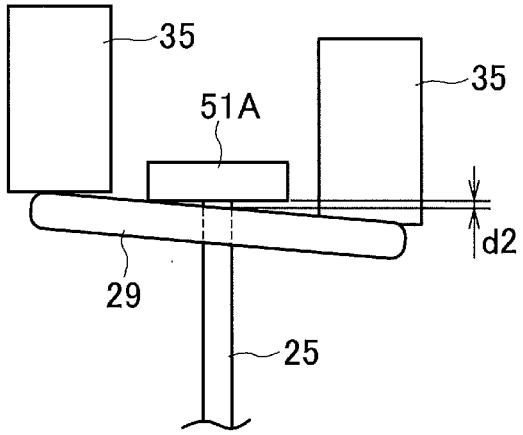

Incidentally, as shown in FIGS. 7A and 7B, in a structure to regulate the relative movement (parallel movement and relative rotational movement) of the movable contactor 29 toward one end side (upward: axial direction) by simply using a flat plate-like upper yoke 51A, it is difficult to rotationally move the movable contactor 29 relatively in the axial direction.

Specifically, the movable contactor 29 rotationally moves in a state where one part of a lower side portion of the flat plate-like upper yoke 51A is allowed to abut against the upper surface of the movable contactor 29, while another part of the lower side portion is away from the upper surface of the movable contactor 29 (refer to FIG. 7B).

Meanwhile, in order to regulate the operation of the movable contactor 29 to be opened and separated from the fixed contact points 35*a* by forming the magnetic circuit, a width of the upper yoke 51A needs to be enlarged.

Moreover, in the case where heights of the pair of fixed contact points 35*a* and 35*a* become different from each other owing to an assembly error and the like, it is necessary to make it possible to absorb the assembly error in such a manner that heights of the pair of movable contact points 29*b* and 29*b* are differentiated from each other by rotationally moving the movable contactor 29 by a predetermined angle. Then, if the width of the upper yoke 51A is increased, then as shown in FIG. 7B, a protrusion amount of the shaft 25 from the upper surface of the movable contactor 29 becomes large in such a state where the movable contactor 29 is rotated by the predetermined angle. Hence, in the case where the width of the upper yoke 51A is increased, in order to make it possible to absorb the assembly error by rotationally moving the movable contactor 29 by the predetermined angle, it is necessary to increase a moving distance (stroke) d2 of the shaft 25.

As described above, it had such a structure to make it difficult to rotationally move the movable contactor 29 relatively in the axial direction because in the case where simply the flat plate-like upper yoke 51A is used, it is necessary to increase the moving distance (stroke) d2 of the shaft 25.

In this connection, it is made possible, in this embodiment, to relatively rotationally move the movable contactor 29 more easily.

Specifically, between the movable contactor 29 and the regulating portion 60, a rotational movement deregulating portion 80 is formed to relax the regulation for the relative rotational movement of the movable contactor 29 in the axial direction by the regulating portion 60.

In this embodiment, on a center of a lower portion of the upper yoke 51, a protruding portion 51*c* protruding downward (movable contactor 29 side), is formed integrally therewith, the protruding portion 51*c* being configured to abut against the upper surface of the movable contactor 29. Then, the protruding portion 51*c* formed on the upper yoke 51 (regulating portion 60) as at least either one of the movable contactor 29 and the upper yoke 51 (regulating portion 60) is defined as the rotational movement deregulating portion 80. That is to say, the protruding portion 51*c* formed on the upper yoke 51 as at least either one of the movable contactor 29 and the upper yoke 51 as the regulating portion 60 is configured to serve also as the rotational movement deregulating portion 80. Note that the protruding portion 51*c* can be formed by doweling a plate-like member. As described above, if the protruding portion 51*c* is formed by doweling the plate-like member, then the seat surface 51*b* can be formed simultaneously with the formation of the protruding portion 51*c*. Moreover, by forming the protruding portion 51*c* as the rotational movement deregulating portion 80, the rotational movement deregulating portion 80 comes to have a step difference portion 80*b* on an opposite surface 80*a* thereof to the movable contactor (movable contactor or regulating portion) 29.

As described above, in this embodiment, a flat plate portion 51*d* on the upper portion of the upper yoke 51 corresponds to the regulating portion 60, and the protruding portion 51*c* on the lower portion of the upper yoke 51 corresponds to the rotational movement deregulating portion 80.

At this time, the movable contactor 29 and the regulating portion 60 (flat plate portion 51*d* on the upper portion of the upper yoke 51) are arranged at an interval from each other in the axial direction by the rotational movement deregulating portion 80 (protruding portion 51*c*). Moreover, when viewed from the above, the regulating portion 60 (flat plate portion 51*d* on the upper portion of the upper yoke 51) is formed so as to cover such an abutment portion of the rotational movement deregulating portion 80 (protruding portion 51*c*) against the movable contactor 29 (movable contactor or regulating portion).

By adopting such a configuration, the magnetic circuit is formed, whereby the operation that the movable contactor 29 is opened and separated from the fixed contact points 35*a* is regulated. Accordingly, even if the width of the flat plate portion 51*d* of the upper yoke 51 is increased, a contact width thereof with the upper surface of the movable contactor 29 can be reduced. That is to say, while the protruding portion 51*c* narrower in width than the flat plate portion 51*d* stays abutting against the upper surface of the movable contactor 29, the magnetic circuit can be formed thereon by the flat plate portion 51*d*.

Figure 6A:
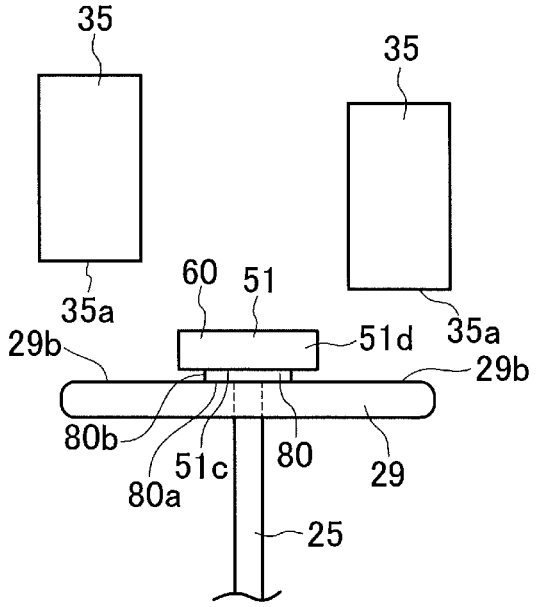
FIGS. 6A and 6B are side views schematically showing operations of the movable contactor and a regulating portion according to the embodiment of the present invention.
Figure 6B:
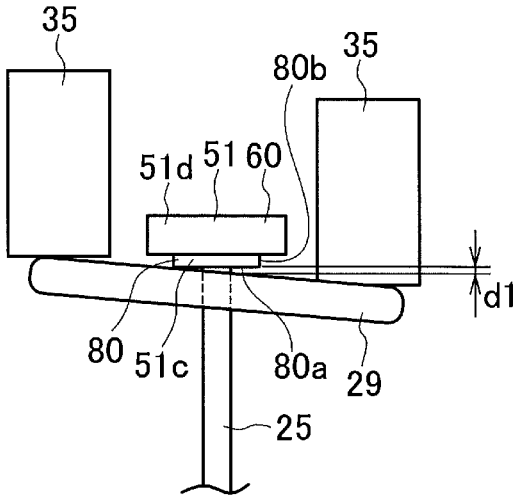

In such a way, as shown in FIGS. 6A and 6B, in the event of rotationally moving the movable contactor 29 by the same predetermined angle as in FIG. 7B in the case where the heights of the fixed contact points 35*a* and 35*a* become different from each other (in the same state as in FIG. 7B), a distance (stroke) d1 of moving the shaft 25 can be reduced more in comparison with that in the structure in FIG. 7 ($d1 < d2$).

As described above, in this embodiment, the rotational movement deregulating portion 80, which absorbs the regulation for the relative rotational movement of the movable contactor 29 in the axial direction by the regulating portion 60, is formed between the movable contactor 29 and the regulating portion 60. As a result, the regulation for the relative rotational movement of the movable contactor 29 in the axial direction by the regulating portion 60 is absorbed, thereby facilitating relative rotational movement of the movable contactor 29.

Furthermore, in this embodiment, the protruding portion 51*c* as the rotational movement deregulating portion 80 is provided on the upper yoke 51 to reduce the contact width of the upper yoke 51 with the movable contactor 29. Therefore, the distance (stroke) of moving the shaft 25 in order to rotationally move the movable contactor 29 by the predetermined angle can be reduced more in comparison with the case where the protruding portion 51*c* is not provided, so that mobility of the contact point device 1 can be suppressed from being lost.

Moreover, in this embodiment, the protruding portion 51*c* formed on the upper yoke 51 (regulating portion 60) as at least either one of the movable contactor 29 and the upper yoke 51 (regulating portion 60) is defined as the rotational movement deregulating portion 80. Therefore, the parts count can be reduced, and in addition, the contact point device 1 can be assembled more easily.

Moreover, in this embodiment, the movable contactor 29 and the regulating portion 60 (flat plate portion 51*d* on the upper portion of the upper yoke 51) are arranged at an interval from each other in the axial direction by the rotational movement deregulating portion 80 (protruding portion 51*c*). Therefore, the movable contactor 29, until the lower side portion of the flat plate portion 51*d* abuts against the movable contactor 29, can relatively rotationally move without being disturbed by the regulating portion 60 (flat plate portion 51*d*). Meanwhile, the lower side portion of the flat plate portion 51*d* abuts against the movable contactor 29, whereby further relative rotational movement of the movable contactor 29 is regulated by the regulating portion 60 (flat plate portion 51*d*). As described above, in this embodiment, while facilitating the movable contactor 29 to be relatively rotationally moved by the rotational movement deregulating portion 80 (protruding portion 51*c*), it is made possible to regulate the movable contactor 29 from relatively rotationally moving too much by the regulating portion 60 (flat plate portion 51*d*).

Moreover, in this embodiment, when viewed from the above, the regulating portion 60 (flat plate portion 51*d* on the upper portion of the upper yoke 51) is formed so as to cover the abutment portion of the rotational movement deregulating portion 80 (protruding portion 51*c*) against the movable contactor 29 (movable contactor or regulating portion). As a result, while preventing as much as possible yoke functions of the upper yoke 51 from being damaged, it is made possible to facilitate the movable contactor 29 to relatively rotationally move by the rotational movement deregulating portion 80 (protruding portion 51*c*).

Note that although the embodiment described above exemplified the case where the contact pressure spring 33 urges the movable contactor 29 upward (towards a first side in the axial direction) via the lower yoke 52, the embodiment is not limited thereto. For example, the constitution shown in FIG. 8 and FIG. 9 may also be applicable.

Figure 8:
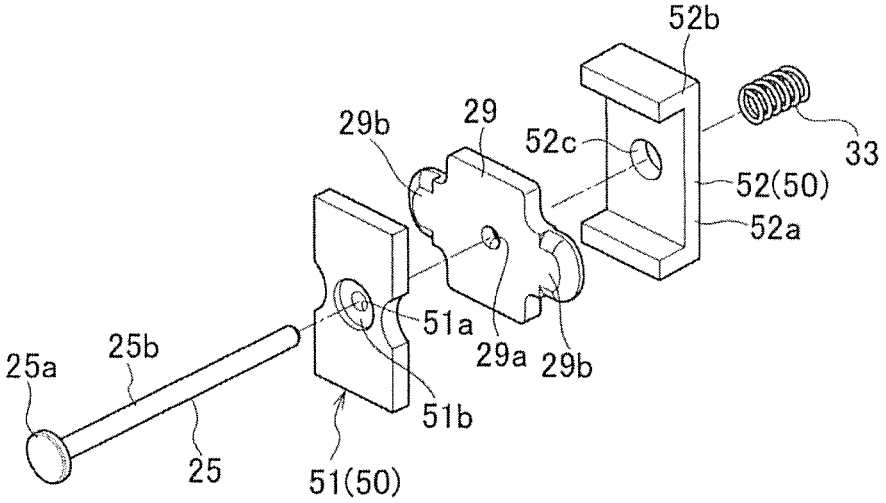
FIG. 8 is an exploded perspective view schematically showing an attached state of a movable contactor and yokes to a drive shaft according to another embodiment of the present invention.
Figure 9:
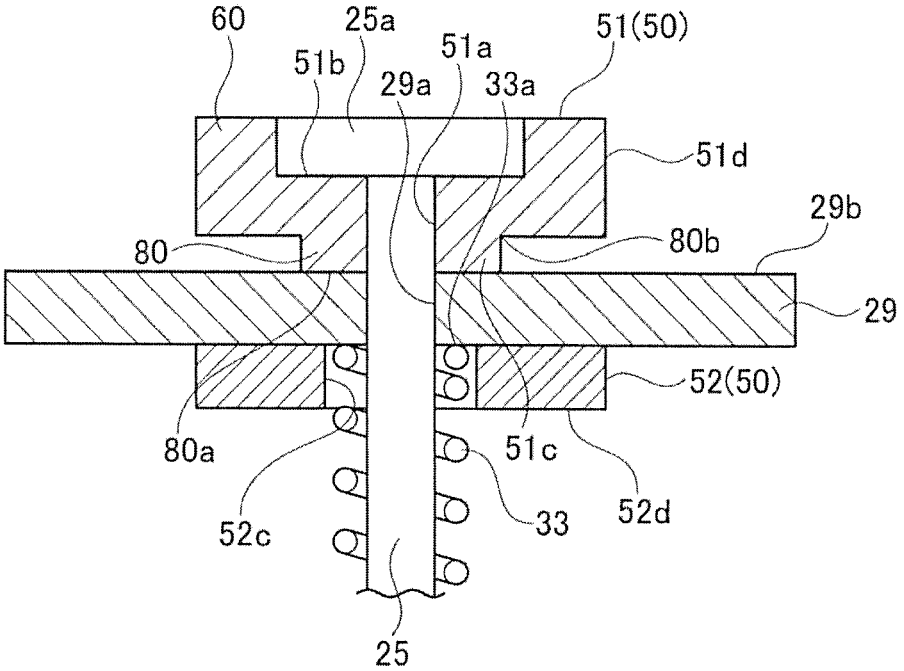
FIG. 9 is a cross-sectional view schematically showing the attached state of the movable contactor and the yokes to the drive shaft according to the other embodiment of the present invention.

FIG. 8 and FIG. 9 each show a state where the protruding portion 51*c* protruding downward (towards the movable contactor 29) is formed integrally therewith on the lower center portion of the upper yoke 51 so that the protruding portion 51*c* abuts against the upper surface of the movable contactor 29. The protruding portion 51*c* formed on the upper yoke 51 (the regulating portion 60) as at least one of the movable contactor 29 and the upper yoke 51 (the regulating portion 60) is defined as the rotational movement deregulating portion 80.

In addition, the contact pressure spring (the biasing member) 33 includes a biasing end which is located on the upper side (towards the first side in the axial direction of the drive shaft: on the movable contactor 29 side) of a lower surface 52*d* of the lower yoke (first yoke) 52 (a surface of the yoke 50 on a second side in the axial direction of the drive shaft) and which applies an upward biasing force to the movable contactor 29 not via the lower yoke 52 (the yoke 50).

In particular, as shown in FIG. 9, the diameter of the insertion hole 52*c* of the lower yoke 52 is increased so as to be larger than the diameter of the insertion hole 29*a* of the movable contactor 29 and the diameter of the shaft 25, and the insertion hole 52*c* is arranged in a manner as to be concentric with the insertion hole 29*a*. The upper portion of the contact pressure spring (the biasing member) 33 is inserted into the gap between the insertion hole 52*c* and the shaft 25 so that the upper end (the biasing end) 33*a* comes into contact with the lower surface 29*d* of the movable contactor 29 (a portion of the lower surface 29*d* not overlapping the lower yoke 52 as viewed from the bottom).

As explained above, in FIG. 8 and FIG. 9, the insertion hole (the hole) 52*c* is formed to pass through the lower yoke 52 at least in the axial direction of the drive shaft, and the upper end (the biasing end) 33*a* of the contact pressure spring (the biasing member) 33 is positioned inside the insertion hole (the hole) 52*c*.

Thus, the upward biasing force is applied to the movable contactor 29 in a manner such that the upper end (the biasing end) 33*a* of the contact pressure spring (the biasing member) 33 does not come into contact with the lower yoke 52 (the yoke 50) (not via the yoke). Namely, in FIG. 8 and FIG. 9, the contact pressure spring (the biasing member) 33 directly urges the movable contactor 29 upward not via the lower yoke 52 (the yoke 50).

Here, the upper end (the biasing end) 33*a* is only required not to come into contact with the lower yoke 52 (the yoke 50) in the vertical direction (in the axial direction of the drive shaft). In other words, the definition of the state of not coming into contact with the lower yoke 52 (the yoke 50) does not exclude a state, for example, where the upper end (the biasing end) 33*a* comes into contact with the side surface of the lower yoke 52 (the yoke 50) (the inner peripheral surface of the insertion hole 52*c*) because of a lateral shift of the contact pressure spring (the biasing member) 33.

Such a configuration can also achieve the same effects as those of the embodiment described above.

In FIG. 8 and FIG. 9, the contact pressure spring (the biasing member) 33 includes the upper end (the biasing end) 33*a* which is positioned on the upper side (towards the first side in the axial direction of the drive shaft: on the movable contactor 29 side) of the lower surface 52*d* of the lower yoke (the first yoke) 52 (the surface of the yoke 50 on the second side in the axial direction of the drive shaft) and which applies the upward biasing force to the movable contactor 29 without coming into contact with the lower yoke 52 (the yoke 50) (not via the yoke). Accordingly, a reduction in size of the contact point device 1 in the height direction (in the vertical direction: in the axial direction of the drive shaft) can be achieved.

Note that the rotational movement deregulating portion 80 is not limited to the one mentioned above, but can be formed by a variety of methods.

For example, it is also possible to form the rotational movement deregulating portion 80 as shown in FIGS. 10A to 10J.

Figure 10A:
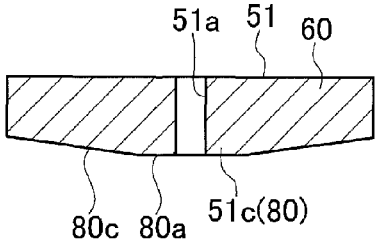
FIGS. 10A to 10J are cross-sectional views schematically showing the movable contactors each provided with a rotational movement deregulating portion.

FIG. 10A shows one, in which the lower surface side of the plate-like upper yoke 51 is inclined outward and upward, whereby the contact width with the movable contactor 29 is reduced. For example, such a shape can be formed by heading and the like. Then, by adopting such a shape, the rotational movement deregulating portion 80 has an inclined surface 80*c* on the opposite surface 80*a* thereof to the movable contactor (movable contactor or regulating portion) 29. Note that, also by adopting each of shapes of FIGS. 10E and 10F, which are to be described later, the rotational movement deregulating portion 80 has the inclined surface 80*c* on the opposite surface 80*a* thereof to the movable contactor (movable contactor or regulating portion) 29.

Figure 10B:
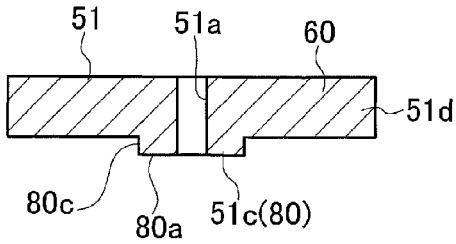

FIG. 10B shows one, in which the seat surface 51*b* is not formed while the protruding portion 51*c* shown in the above-described embodiment is formed. Such a shape can also be formed, for example, by the heading and the like. Then, by adopting such a shape, the rotational movement deregulating portion 80 has the step difference portion 80*b* on the opposite surface 80*a* thereof to the movable contactor (movable contactor or regulating portion) 29. Note that, also by adopting shapes of FIG. 10C, FIG. 10D and FIGS. 10G to 10J, which are to be described later, the rotational movement deregulating portion 80 has the step difference portion 80*b* on the opposite surface 80*a* thereof to the movable contactor (movable contactor or regulating portion) 29.

Figure 10C:
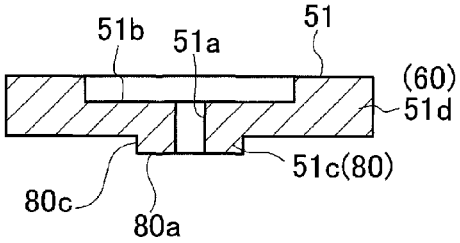
Figure 10D:
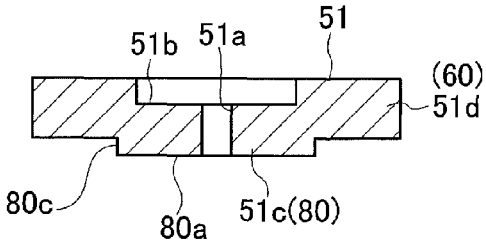

FIG. 10C and FIG. 10D illustrate ones, in each of which widths of upper and lower processed portions are differentiated from each other, among those having the protruding portion 51*c* formed by doweling the plate-like member. Note that, the above-described embodiment illustrates the one in which the widths of the upper and lower processed portions are the same.

Figure 10E:
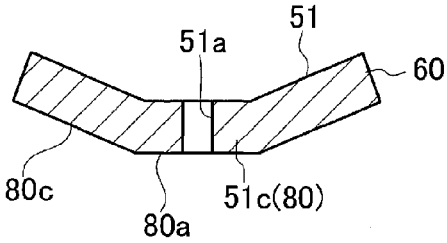
Figure 10F:
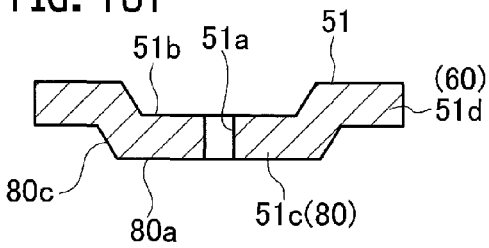

FIG. 10E and FIG. 10F show those, in each of which a plate-like member is bent, whereby the lower surface side of the upper yoke 51 is inclined outward and upward, and the contact width with the movable contactor 29 is reduced. In particular, FIG. 10F shows one with a shape, in which the plate-like member is bent as shown in FIG. 10E, and thereafter, tip ends thereof are further bent.

Figure 10G:
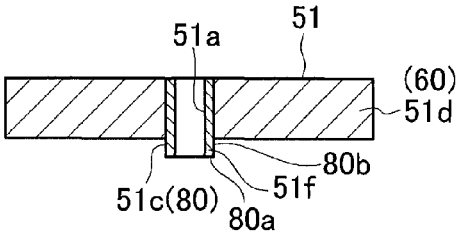
Figure 10H:
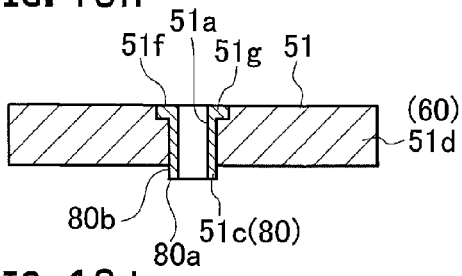
Figure 10I:
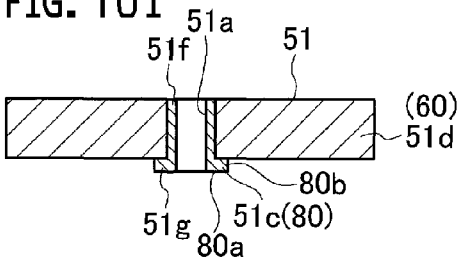
Figure 10J:
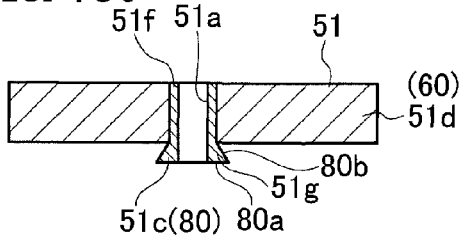

FIG. 10G to FIG. 10J show those, in each of which a cylindrical member 51*f* as a separate member is inserted into an insertion hole 51*e* of the plate-like upper yoke 51, whereby the protruding portion 51*c* is formed. As shown in FIG. 10G, a simply cylindrical one is also usable as the cylindrical member 51*f*. Moreover, as shown in FIG. 10H, it is also possible to form the protruding portion 51*c* in such a manner that a flange portion 51*g* is provided on an upper portion thereof, and falloff of the cylindrical member 51*f* is prevented by the flange portion 51*g*. Furthermore, as shown in FIG. 10I, such a structure may be adopted, in which the flange portion 51*g* is provided on a lower side of the cylindrical member 51*f*, such that the flange portion 51*g* becomes the protruding portion 51*c*. This flange portion 51*g* can also be formed into a shape as shown in FIG. 10J, and is formable into other various shapes.

Even if such shapes are adopted, similar functions and effects to those of the above-described embodiment can be exerted.

Figure 11:
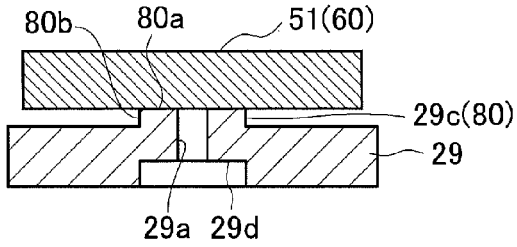
FIG. 11 is a cross-sectional view schematically showing the regulating portion provided with the rotational movement deregulating portion.

Moreover, as shown in FIG. 11, it is also possible to form a protruding portion 29*c* as the rotational movement deregulating portion 80 on the movable contactor 29. Also in FIG. 11, the protruding portion 29*c* is formed by doweling a plate-like member. At this time, a recessed portion 29*d* is formed on the lower surface side of the movable contactor 29. Then, by adopting such a shape, the rotational movement deregulating portion 80 has the step difference portion 80*b* on the opposite surface 80*a* thereof to the upper yoke (movable contactor or regulating portion) 51 as the regulating portion.

Moreover, it is also possible to form the rotational movement deregulating portion 80 as shown in FIGS. 12A to 12J.

Figure 12A:
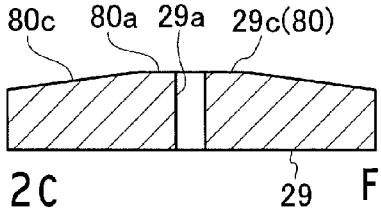
FIGS. 12A to 12J are cross-sectional views schematically showing modification examples of FIG. 11.

FIG. 12A shows one, in which the upper surface side of the plate-like movable contactor 29 is inclined outward and downward, whereby the contact width with the upper yoke 51 is reduced. Such a shape can be formed, for example, by the heading and the like. Then, by adopting such a shape, the rotational movement deregulating portion 80 has the inclined surface 80*c* on the opposite surface 80*a* thereof to the upper yoke (movable contactor or regulating portion) 51. Note that, also by adopting each of shapes of FIGS. 12E and 12F, which are to be described later, the rotational movement deregulating portion 80 has the inclined surface 80*c* on the opposite surface 80*a* thereof to the upper yoke (movable contactor or regulating portion) 51.

Figure 12B:
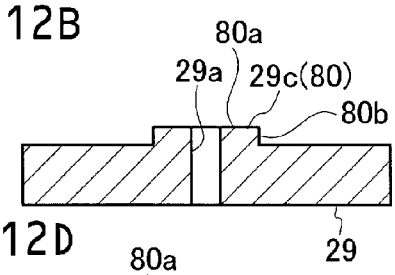

FIG. 12B shows one in which the recessed portion 29*d* is not formed while the protruding portion 29*c* as shown in FIG. 11 is formed. Such a shape can also be formed, for example, by the heading and the like.

Figure 12C:
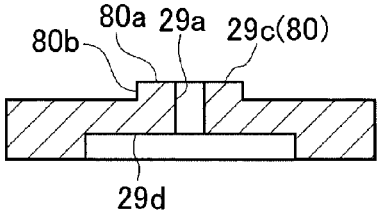
Figure 12D:
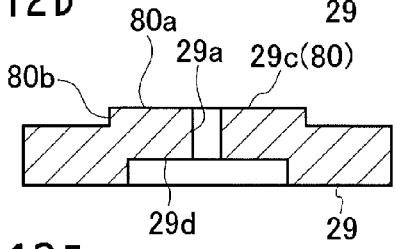

FIG. 12C and FIG. 12D illustrate those, in each of which widths of upper and lower processed portions are differentiated from each other, among those in each of which the protruding portion 29*c* is formed by doweling the plate-like member. Note that, in FIG. 11, the one in which the widths of the upper and lower processed portions are the same is illustrated.

Figure 12E:
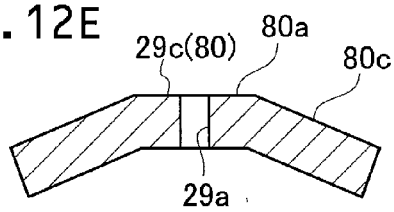
Figure 12F:
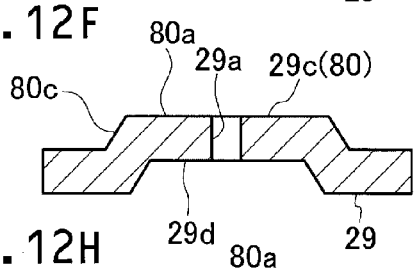

FIG. 12E and FIG. 12F illustrate those, in each of which a plate-like member is bent, whereby the upper surface side of the movable contactor 29 is inclined outward and downward, and the contact width with the upper yoke 51 is reduced. In particular, FIG. 12F shows one with a shape, in which the plate-like member is bent as shown in FIG. 12E, and thereafter, tip ends thereof are further bent.

Figure 12G:
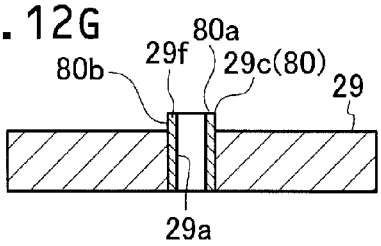
Figure 12H:
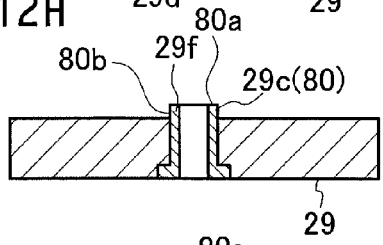
Figure 12I:
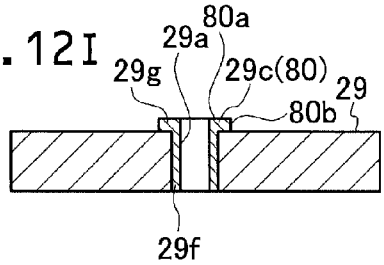
Figure 12J:
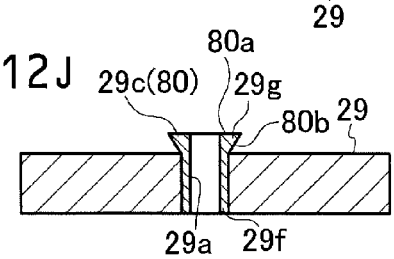

FIG. 12G to FIG. 12J show those, in each of which a cylindrical member 29*f* as a separate member is inserted into an insertion hole 29*e* of the plate-like movable contactor 29, whereby the protruding portion 29*c* is formed. As shown in FIG. 12G, as the cylindrical member 29*f*, a simply cylindrical one is also usable. Moreover, as shown in FIG. 12H, it is also possible to form the protruding portion 29*c* in such a manner that a flange portion 29*g* is provided on a lower side thereof, and falloff of the cylindrical member 29*f* is prevented by the flange portion 29*g*. Furthermore, as shown in FIG. 12I, such a structure may be adopted, in which the flange portion 29*g* is provided on an upper side of the cylindrical member 29*f*, and the flange portion 29*g* becomes the protruding portion 29*c*. This flange portion 29*g* can also be formed into a shape as shown in FIG. 12J, and is formable into other various shapes.

Even if such shapes are adopted, similar functions and effects to those of the above-described embodiment can be exerted.

Note that, in the case of forming the rotational movement deregulating portion 80 by bending, the rotational movement deregulating portion 80 can be formed integrally with the upper yoke 51 or the movable contactor 29, and accordingly, the parts count can be reduced, and in addition, the contact point device 1 can be assembled more easily.

Moreover, in the case of forming, by using the separate member, the rotational movement deregulating portion 80 integrally with the upper yoke 51 or the movable contactor 29, the rotational movement deregulating portion 80 can be formed without being affected by workability of the upper yoke 51 or the movable contactor 29, and a degree of shape freedom of the rotational movement deregulating portion 80 can be enhanced. Furthermore, the rotational movement deregulating portion 80 is formed integrally with the upper yoke 51 or the movable contactor 29, whereby the parts count can be reduced, and in addition, the contact point device 1 can be assembled more easily.

Figure 13A:
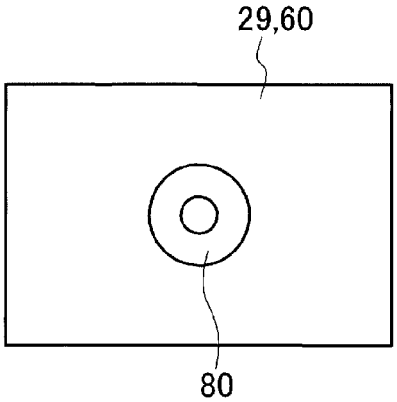
FIGS. 13A to 13D are plan views schematically showing planar shapes of the rotational movement deregulating portion.
Figure 13B:
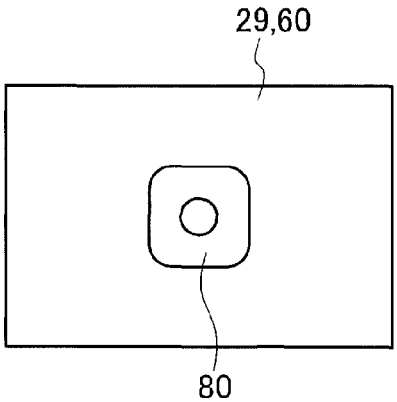
Figure 13C:
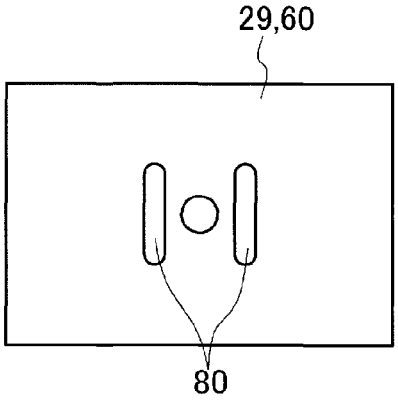
Figure 13D:
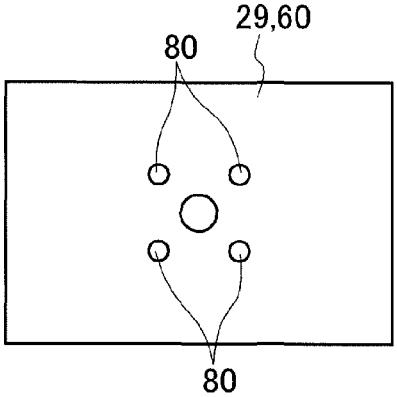

Moreover, it is possible to make a planar shape of the rotational movement deregulating portion 80 into shapes as shown in FIGS. 13A to 13D. That is to say, as shown in FIG. 13A, the rotational movement deregulating portion 80 may be formed into an annular shape, or as shown in FIG. 13B, may be formed into a shape in which an outer periphery side becomes substantially rectangular. Moreover, as shown in FIG. 13C, the rotational movement deregulating portion 80 may be protruded in a linear shape on both sides of the insertion hole, or as shown in FIG. 13D, a plurality of protruding portions (rotational movement deregulating portions 80) may be provided so as to surround the periphery of the insertion hole.

Even if such shapes are adopted, similar functions and effects to those of the above-described embodiment can be exerted.

Figure 14:
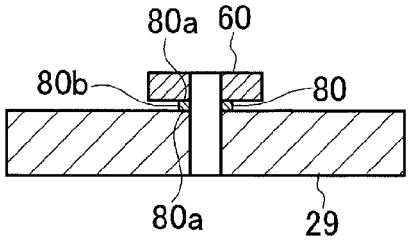
FIG. 14 is a cross-sectional view schematically showing one in which the rotational movement deregulating portion is formed of a different member independent of the movable contactor and the regulating portion.
Figure 15A:
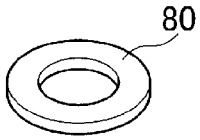
FIGS. 15A and 15B are perspective views schematically illustrating shapes of the rotational movement deregulating portion used in FIG. 14.
Figure 15B:
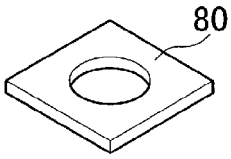

Moreover, as shown in FIG. 14 and FIGS. 15A and 15B, the rotational movement deregulating portion 80 may be formed of a separate member from the movable contactor 29 and the regulating portion 60, to be assembled thereto in an independent state.

In such a way, the rotational movement deregulating portion 80 can be formed without being affected by workability of the regulating portion 60 or the movable contactor 29, and a degree of shape freedom of the rotational movement deregulating portion 80 can be enhanced.

Figure 16A:
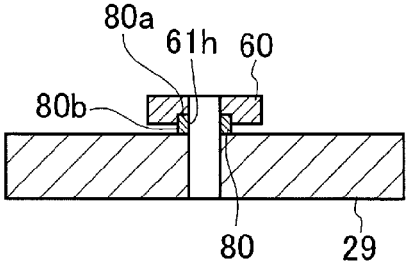
FIGS. 16A and 16B are cross-sectional views schematically showing modification examples of an attached state of the rotational movement deregulating portion used in FIG. 14.
Figure 16B:
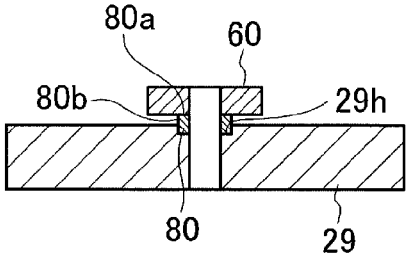

Moreover, in the case of using the rotational movement deregulating portion 80 as the separate member, then as shown in FIG. 16A or 16B, a housing recessed portion 61*h* or 29*h* may be formed in the regulating portion 60 or the movable contactor 29, and the rotational movement deregulating portion 80 may be housed therein.

Figure 17A:
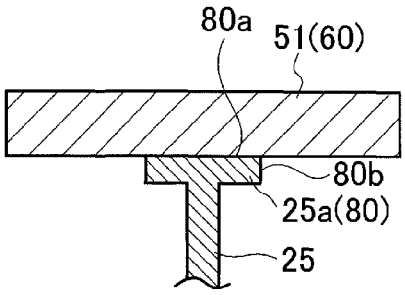
FIGS. 17A and 17B are cross-sectional views schematically showing those in each of which a head portion of a drive shaft is used as the rotational movement deregulating portion.
Figure 17B:
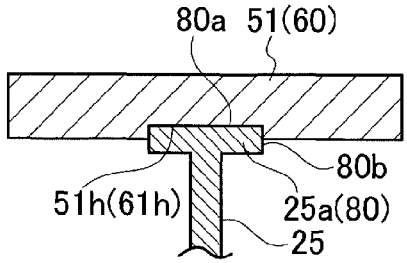
Figure 18A:
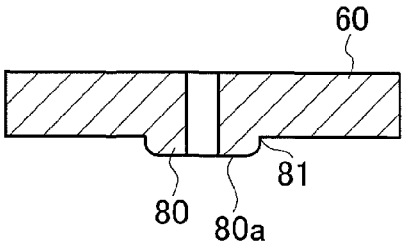
FIGS. 18A to 18D are cross-sectional views schematically showing modification examples of the one in which the rotational movement deregulating portion is provided in the regulating portion.
Figure 18B:
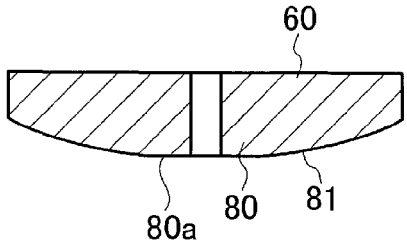
Figure 18C:
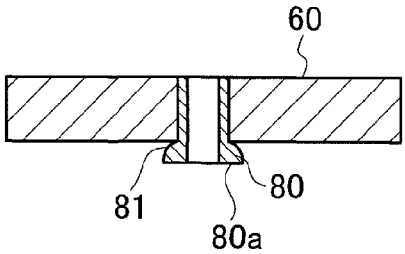
Figure 18D:
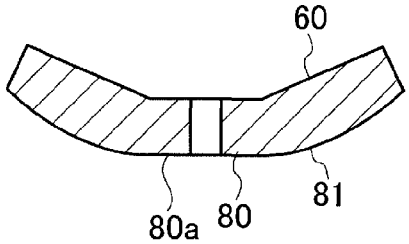
Figure 19A:
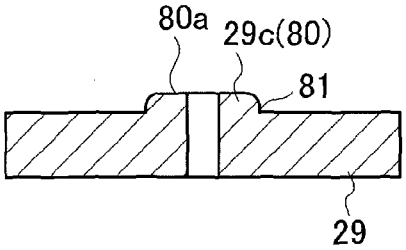
FIGS. 19A to 19D are cross-sectional views schematically showing modification examples of the movable contactor in each of which the rotational movement deregulating portion is provided in the movable contactor.
Figure 19B:
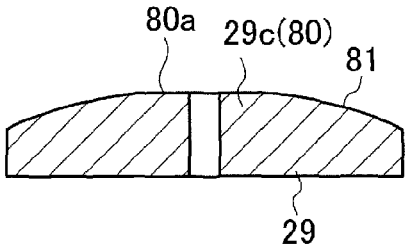
Figure 19C:
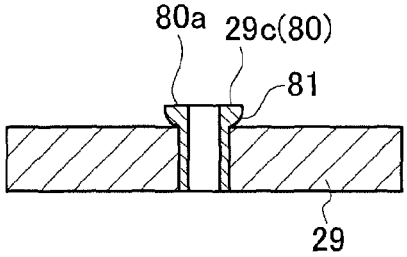
Figure 19D:
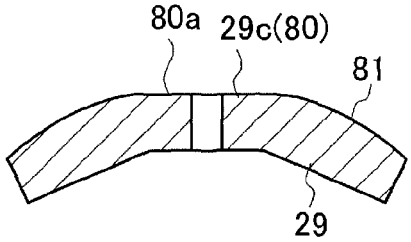

Moreover, as shown in FIG. 17A or 17B, the flange portion 25*a* of the shaft 25 is fixed to the lower surface of the upper yoke 51 (regulating portion 60), whereby the flange portion 25*a* may be allowed to function as the rotational movement deregulating portion 80. At this time, the flange portion 25*a* may be housed in a housing recessed portion 51*h* (61*h*) formed in the upper yoke 51 (regulating portion 60) (refer to FIG. 17B).

Note that, with regard to a set of the rotational movement deregulating portion 80 and the movable contactor 29 and a set of the rotational movement deregulating portion 80 and the regulating portion 60, both in each set are provided as separate bodies, or provided integrally with each other by using separate materials, whereby the rotational movement deregulating portion 80 and the movable contactor 29 may include separate members, or the rotational movement deregulating portion 80 and the regulating portion 60 may include separate members.

Moreover, as shown in each of FIGS. 18A to 18D to FIG. 21, a curved surface portion 81 may be formed on an outside of an abutment portion of the rotational movement deregulating portion 80 against the movable contactor 29 or the regulating portion 60. That is to say, the rotational movement deregulating portion 80 may have the curved surface portion 81 on the opposite surface 80*a* thereof to the movable contactor 29 or the regulating portion 60.

Each of FIGS. 18A to 18D illustrates one in which the rotational movement deregulating portion 80 is provided in the regulating portion 60, wherein the curved surface portion 81 is provided on the outer periphery side of the rotational movement deregulating portion 80.

Each of FIGS. 19A to 19D illustrates one in which the protruding portion 29*c* as the rotational movement deregulating portion 80 is provided on the movable contactor 29, wherein the curved surface portion 81 is provided on the outer periphery side of the protruding portion 29*c*.

Figure 20A:
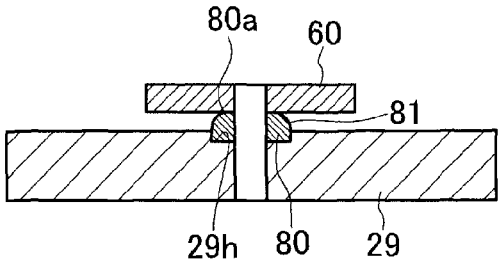
FIGS. 20A to 20C are cross-sectional views schematically showing modification examples of the one in which the rotational movement deregulating portion is formed of the different member independent of the movable contactor and the regulating portion.
Figure 20B:
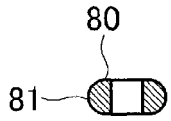
Figure 20C:
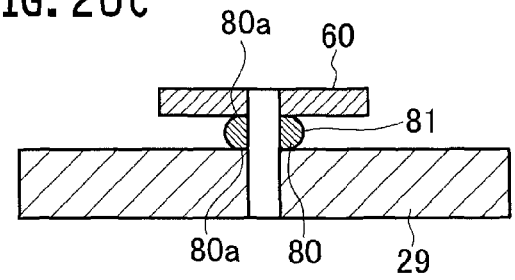

Each of FIGS. 20A to 20C illustrates one in which the rotational movement deregulating portion 80 is formed of the separate member from the movable contactor 29 and the regulating portion 60, and is assembled thereto in the independent state, wherein the curved surface portion 81 is provided on the outer periphery side of the rotational movement deregulating portion 80. Note that the curved surface portion 81 may be provided only on one side (upper side) in the up-down direction as shown in FIG. 20A, or alternatively, may be provided on both sides in the up-down direction as shown in FIG. 20B and FIG. 20C.

Figure 21:
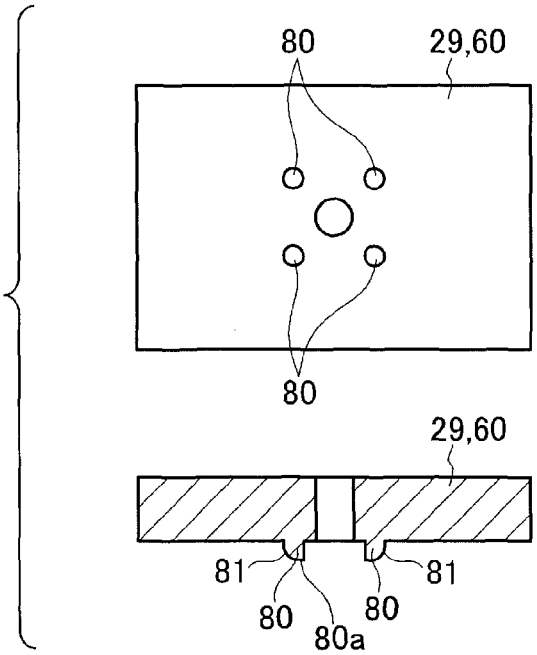
FIG. 21 illustrates views schematically showing modification examples of the planar and cross-sectional shapes of the rotational movement deregulating portion.

FIG. 21 illustrates one in which the plurality of protruding portions (rotational movement deregulating portions 80) are provided so as to surround the periphery of the insertion hole as shown in FIG. 13D, wherein the curved surface portion 81 is provided on the outer periphery side of the rotational movement deregulating portion 80. Note that the entirety of the plurality of protruding portions (rotational movement deregulating portions 80) may be protruded in a hemispherical shape.

Even if such shapes are adopted, similar functions and effects to those of the above-described embodiment can be exerted.

Moreover, the curved surface portion 81 is formed on the outside of the abutment portion of the rotational movement deregulating portion 80 against the movable contactor 29 or the regulating portion 60, whereby a motion of the movable contactor 29 at the time when the movable contactor 29 relatively rotationally moves and absorbs the step difference can be smoothened. As a result, in the event where the contact point device 1 is repeatedly used, the movable contactor 29 and the rotational movement deregulating portion 80 can be suppressed from being deformed to be able to achieve a longer life thereof.

Moreover, in the above-described embodiment, one is illustrated, in which the upper yoke 51 is formed into the substantially rectangular plate shape, and the lower yoke 52 is formed into the substantially U-like shape by using the bottom wall portion 52*a* and the sidewall portions 52*b* formed so as to upstand from both ends of the bottom wall portion 52*a*. However, for the shapes of the upper yoke 51 and the lower yoke 52, it is also possible to adopt shapes shown in FIGS. 22A to 22F.

Figure 22A:
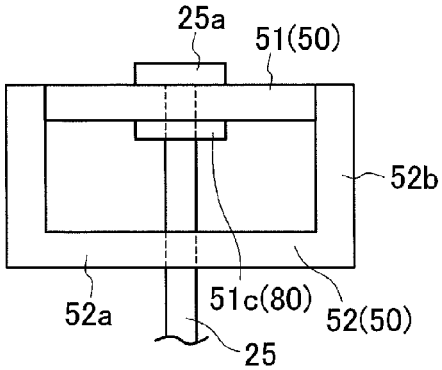
FIGS. 22A to 22F are side views schematically showing modification examples of the upper and lower yokes.

Specifically, as shown in FIG. 22A, the upper yoke 51 with the substantially rectangular plate shape is sandwiched by the sidewall portions 52*b* and 52*b* of the lower yoke 52 with the substantially U-like shape, whereby the movable contactor 29 may be surrounded by the upper yoke 51 and the lower yoke 52.

Figure 22B:
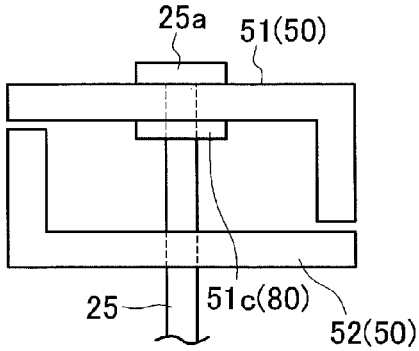

Moreover, as shown in FIG. 22B, the movable contactor 29 may be surrounded by an upper yoke 51 with an L-like shape and a lower yoke 52 with the L-like shape.

Figure 22C:
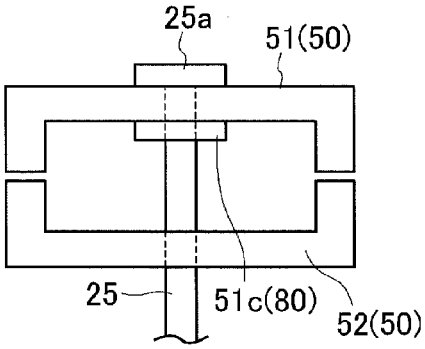
Figure 22D:
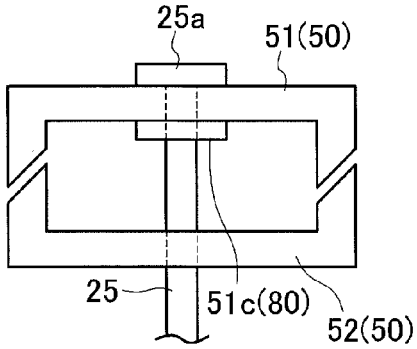

Moreover, as shown in FIG. 22C, the movable contactor 29 may be surrounded by an upper yoke 51 with a U-like shape and a lower yoke 52 with the U-like shape. At this time, as shown in FIG. 22D, it is also possible to skew opposite surfaces of the upper yoke 51 and the lower yoke 52.

Figure 22E:
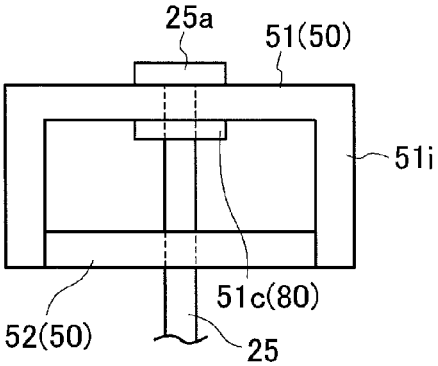
Figure 22F:
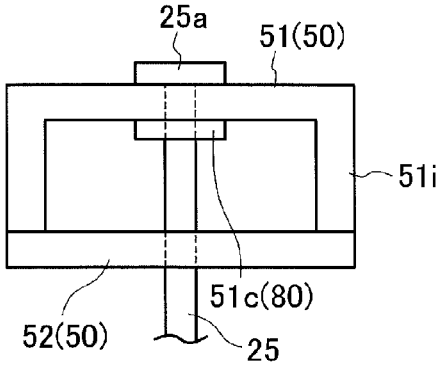

Moreover, as shown in FIG. 22E, the movable contactor 29 may be surrounded by an upper yoke 51 with a U-like shape and a lower yoke 52 with the substantially rectangular plate shape. At this time, the lower yoke 52 with the substantially rectangular plate shape is sandwiched by sidewall portions 51*i* of the upper yoke 51 with the substantially rectangular shape; however, as shown in FIG. 22F, it is also possible to thrust the lower yoke 52 with the substantially rectangular plate shape against sidewall portions 51*i* of the upper yoke 51 with such a substantial U-like shape.

Even if such shapes are adopted, similar functions and effects to those of the above-described embodiment can be exerted.

Figure 23A:
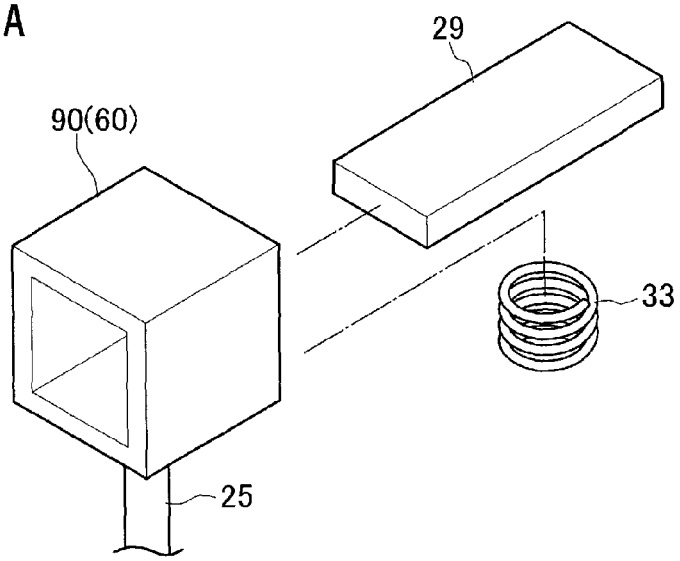
FIGS. 23A to 23C are views schematically showing one configured so that the movable contactor can be held by a holder.
Figure 23B:
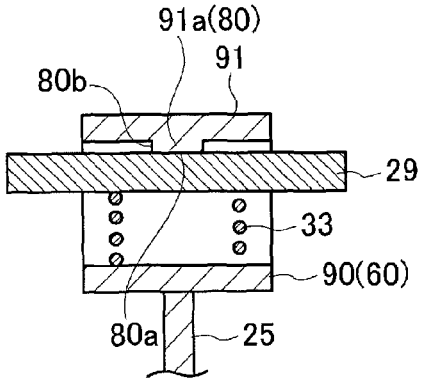
Figure 23C:
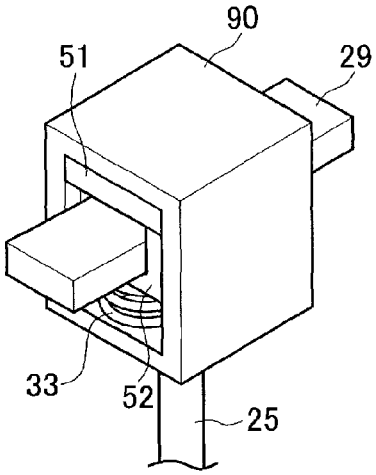

Moreover, as shown in FIGS. 23A to 23C, it is also possible to adopt a structure in which the movable contactor 29 is held by a holder 90.

In FIGS. 23A to 23C, one is illustrated, in which the shaft 25 is fixed to the holder 90 that has a substantially rectangular shape when viewed from side. FIGS. 23A and 23B illustrate one in which the movable contactor 29 and the compressed contact pressure spring 33 are inserted into the inside of the holder 90. Hence, in FIG. 23A and FIG. 23B, the parallel movement of the movable contactor 29 in the axial direction and the relative rotational movement thereof in the axial direction are regulated by a top wall portion 91 of the holder 90.

That is to say, in FIG. 23A and FIG. 23B, the holder 90 functions as the regulating portion 60. Therefore, a protruding portion 91*a* as the rotational movement deregulating portion 80 is formed on a lower surface of the top wall portion 91 of the holder 90.

Even if such shapes are adopted, similar functions and effects to those of the above-described embodiment can be exerted.

Note that, as shown in FIG. 23C, the movable contactor 29 and the compressed contact pressure spring 33 may be inserted into the inside of the holder 90 in a state of being surrounded by the upper yoke 51 and the lower yoke 52.

Figure 24:
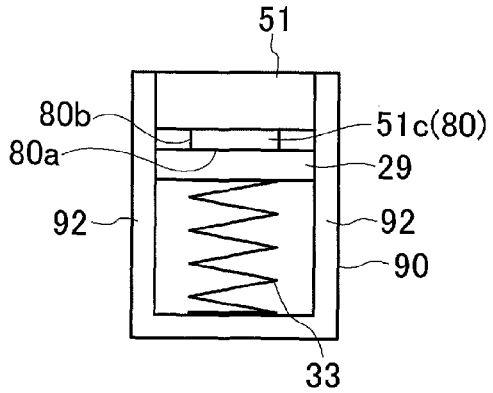
FIG. 24 is a view schematically showing a modification example of the one configured so that the movable contactor can be held by the holder.

Moreover, as shown in FIG. 24, it is also possible to adopt a structure, in which a holder 90 with a U-like shape opened upward is used in place of the holder 90 with the substantially rectangular shape when viewed from side, and the rotational movement deregulating portion 80 is provided between the movable contactor 29 and the regulating portion 60 (upper yoke 51).

Figure 25A:
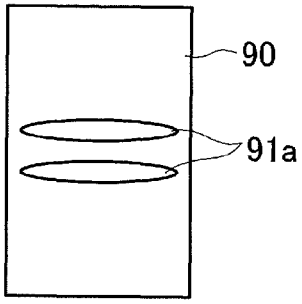
FIGS. 25A and 25B are plan views schematically showing planar shapes of those in each of which the rotational movement deregulating portion is provided in the holder.
Figure 25B:
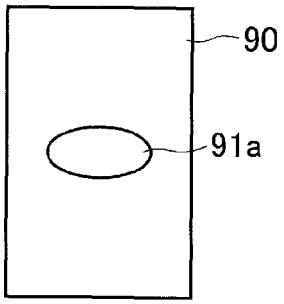

Note that, as shown in FIGS. 25A and 25B, it is possible to form a planar shape of the protruding portion 91*a* as the rotational movement deregulating portion 80 into a shape of one or a plurality of ellipsoids.

Figure 26A:
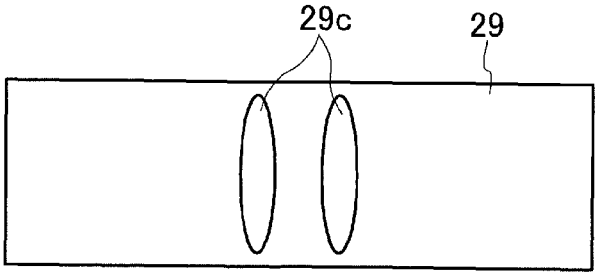
FIGS. 26A and 26B are plan views schematically showing those in each of which the rotational movement deregulating portion is provided in the movable contactor.
Figure 26B:
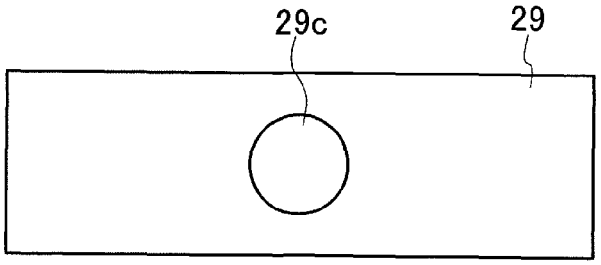

Moreover, as shown in FIGS. 26A and 26B, one or plural ellipsoidal protruding portions 29*c* may be formed on the upper surface of the movable contactor 29.

Figure 27A:
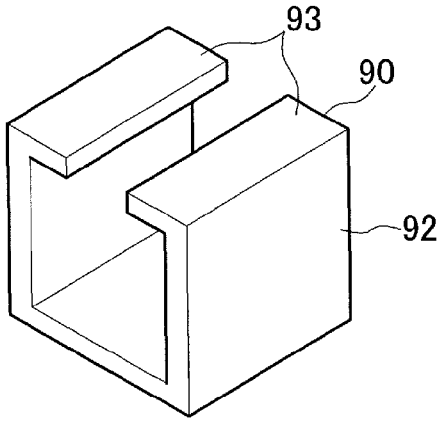
FIGS. 27A and 27B are views schematically showing other modification examples of the one configured so that the movable contactor can be held by the holder.
Figure 27B:
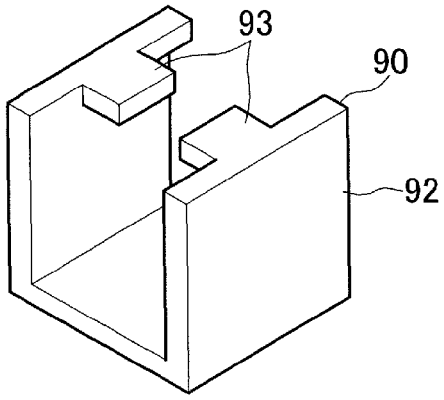

Also, as shown in FIGS. 27A and 27B, the holder 90 may be formed into a C-like shape when viewed from side. In such a way, the movable contactor 29 and the like can be held by presser plates 93 located on the upper side, and it becomes unnecessary to sandwich the movable contactor 29 and the like by the sidewall portions 92 and 92 as shown in FIG. 24.

Figure 28:
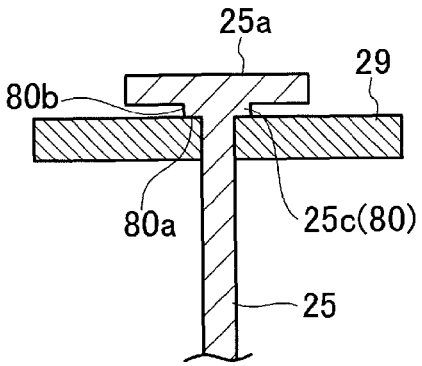
FIG. 28 is a cross-sectional view schematically showing one in which the rotational movement deregulating portion is provided on the head portion of the drive shaft.
Figure 29:
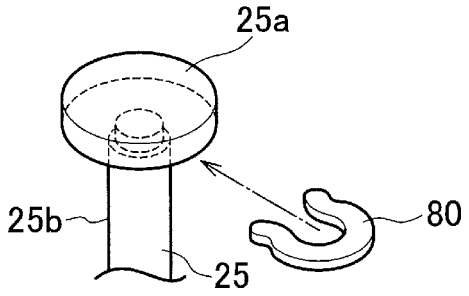
FIG. 29 is a cross-sectional view schematically showing a modification example of the one in which the rotational movement deregulating portion is provided on the head portion of the drive shaft.

Moreover, as shown in FIG. 28, the flange portion 25*a* of the shaft 25 may be allowed to function as the regulating portion 60, and a protruding portion 25*c* as the rotational movement deregulating portion 80 may be formed on the flange portion 25*a*. Note that, as shown in FIG. 29, the rotational movement deregulating portion 80 may be configured by a separate member from the flange portion 25*a*, and the rotational movement deregulating portion 80 may be attached to a shaft body portion 25*b* of the shaft 25.

Figure 30:
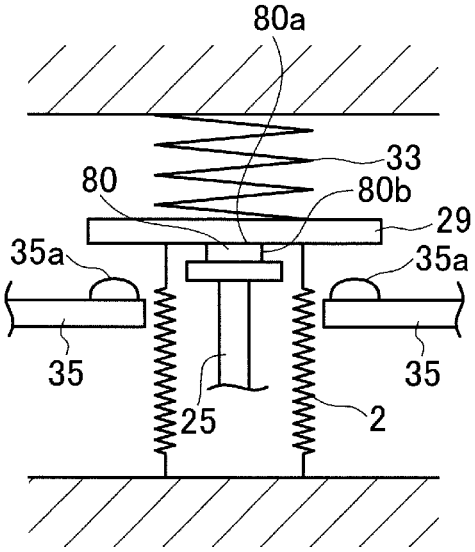
FIG. 30 is a side view schematically showing a modification example of the electromagnetic relay.

Moreover, in the above-described embodiment, one is illustrated, in which the fixed terminals 35 and 35 are provided on the opposite side to the drive block 2 (coil and the like) with respect to the movable contactor 29. However, as shown in FIG. 30, it is also possible to adopt a structure in which the fixed terminals 35 and 35 are provided on the same side as that of the drive block 2 with respect to the movable contactor 29.

Even if such shapes are adopted, similar functions and effects to those of the above-described embodiment can be exerted.

The description has been made above of the preferred embodiment of the present invention; however, the present invention is not limited to the above-described embodiment, but is modifiable in various ways.

Figure 31A:
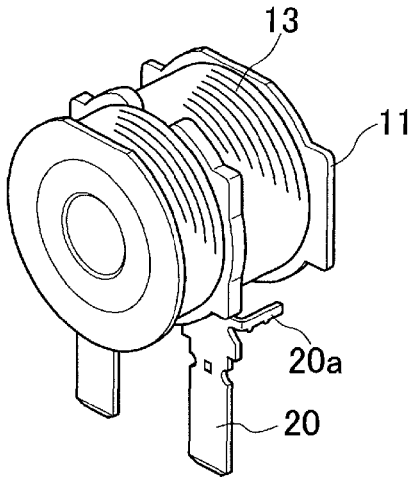
FIGS. 31A and 31B are views schematically showing a modification example of a coil portion.
Figure 31B:
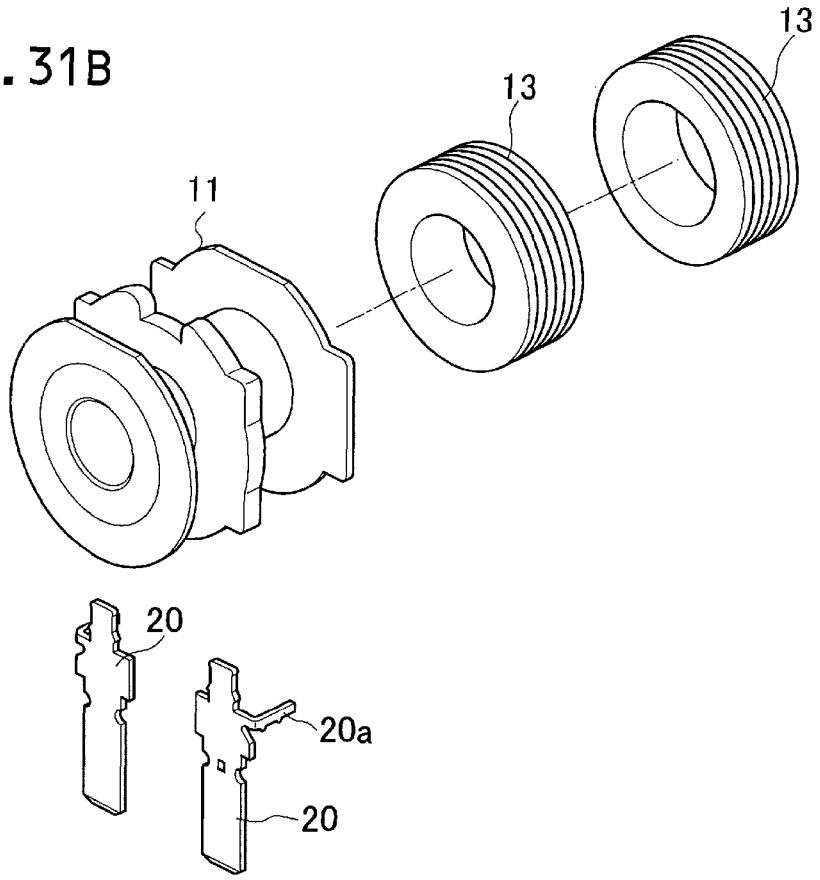

For example, in the above-described embodiment, one is illustrated, in which the coil 13 is wound around one coil bobbin 11; however, as shown in FIGS. 31A and 31B, it is also possible to individually wind the coils 13 around a plurality (two) of the coil bobbins 11.

Moreover, in the above-described embodiment, one is illustrated, in which the movable contactor 29 is surrounded by the upper yoke 51 and the lower yoke 52; however, only either one of the upper yoke 51 and the lower yoke 52 may be provided. Moreover, it is also possible not to provide the yoke itself.

Moreover, it is possible to appropriately combine the structures, which are shown in the above-described embodiment and modification examples thereof, with one another.

Moreover, it is also possible to appropriately change specifications (shapes, sizes, layout and the like) of the movable contactor, the fixed terminals and other details.

What is claimed is:

1. A contact point device comprising:

a contact point block including a fixed terminal in which a fixed contact point is formed, and a movable contactor in which a movable contact point contacting and separating from the fixed contact point is formed; and a drive block including a drive shaft to which the movable contactor is attached and which drives the movable contactor so that the movable contact point can contact and separate from the fixed contact point, wherein the movable contactor is attached to the drive shaft so as to be movable relatively to the drive shaft in an axial direction of the drive shaft, a regulating portion is provided, the regulating portion regulating a relative movement of the movable contactor in the axial direction by allowing the movable contactor to abut against the regulating portion itself, and a rotational movement deregulating portion is formed between the movable contactor and the regulating portion, the rotational movement deregulating portion relaxing the regulation by the regulating portion for the relative rotational movement of the movable contactor in the axial direction.

2. The contact point device according to claim 1, wherein the movable contactor and the regulating portion are arranged at an interval from each other in the axial direction by the rotational movement deregulating portion.

3. The contact point device according to claim 1, wherein, when viewed from above, the regulating portion is formed to cover an abutment portion of the rotational movement deregulating portion against the movable contactor or the regulating portion.

4. The contact point device according to claim 1, wherein the rotational movement deregulating portion is a protruding portion formed on at least either one of the movable contactor and the regulating portion.

5. The contact point device according to claim 4, wherein a plurality of the protruding portions are formed.

6. The contact point device according to claim 1, wherein the rotational movement deregulating portion is formed by bending at least either one of the movable contactor and the regulating portion.

7. The contact point device according to claim 1, wherein the rotational movement deregulating portion is formed of a separate material from the movable contactor and the regulating portion.

8. The contact point device according to claim 1, wherein the rotational movement deregulating portion has a step difference portion on an opposite surface thereof to the movable contactor or the regulating portion.

9. The contact point device according to claim 1, wherein the rotational movement deregulating portion has an inclined surface portion on an opposite surface thereof to the movable contactor or the regulating portion.

10. The contact point device according to claim 1, wherein the rotational movement deregulating portion has a curved surface portion on an opposite surface thereof to the movable contactor or the regulating portion.

11. The contact point device according to claim 1, wherein the contact point block includes a biasing member which urges the movable contactor towards a first side of the movable contactor in the axial direction of the drive shaft, and includes a yoke provided at least on a second side of the movable contactor in the axial direction in a state where the movable contact point is in contact with the fixed contact point, and the biasing member includes a biasing end which is located towards the movable contactor on the second side in the axial direction but separate from a surface of the yoke provided on the second side in the axial direction and which applies a biasing force to the movable contactor not via the yoke.

12. An electromagnetic relay, on which the contact point device according to claim 1 is mounted.

* * * * *